US007127817B2

(12) United States Patent
Orloff et al.

(10) Patent No.: US 7,127,817 B2
(45) Date of Patent: Oct. 31, 2006

(54) SHAVING PREPARATION FOR WET SHAVING ASSEMBLY

(75) Inventors: Glennis J. Orloff, Woodbridge, CT (US); Robert V. Lozeau, Madison, CT (US); David Dombrowski, Madison, CT (US)

(73) Assignee: Eveready Battery Company, Inc., St. Louis, MO (US)

( * ) Notice: Subject to any disclaimer, the term of this patent is extended or adjusted under 35 U.S.C. 154(b) by 0 days.

(21) Appl. No.: 10/365,238

(22) Filed: Feb. 12, 2003

(65) Prior Publication Data

US 2003/0121154 A1 Jul. 3, 2003

Related U.S. Application Data

(62) Division of application No. 09/505,408, filed on Feb. 16, 2000, now Pat. No. 6,584,690.

(51) Int. Cl.
*B26B 21/44* (2006.01)
*B26B 19/40* (2006.01)

(52) U.S. Cl. ..... 30/41; 30/538; 401/195

(58) Field of Classification Search ..... 30/41, 30/49, 34.05, 123, 125, 537, 538, 123.3; 401/42, 195, 261, 25, 26, 27, 139, 14, 48, 401/52, 72, 75, 78, 292, 88, 89, 97; 510/142, 510/143, 144, 449; 424/73; 222/80
See application file for complete search history.

(56) References Cited

U.S. PATENT DOCUMENTS 180,390 A * 7/1876 Strunz ..... 510/449
330,418 A 11/1885 Partridge et al.
951,036 A 3/1910 Waterman
1,229,824 A * 6/1917 Tewelow et al. ..... 30/29.5
1,242,175 A * 10/1917 Grant ..... 401/72

(Continued)

FOREIGN PATENT DOCUMENTS

BE 509715 3/1952

(Continued)

OTHER PUBLICATIONS

European Search Report EP 0 1300318 dated May 23, 2001.
Copy of PCT Search Report for Ser. No. PCT/IB03/01144 dated Oct. 29, 2003.

*Primary Examiner*—Hwei-Siu Payer
(74) *Attorney, Agent, or Firm*—Michaud-Duffy Group LLP

(57) ABSTRACT

A shaving assembly for simultaneously applying a shaving preparation and removing hair in a single step includes a base having an upper end, a lower end and a hollow space between the upper and lower ends, whereby the hollow space defines an opening at the upper end of the base. The shaving assembly includes a receiver for a razor, such as a cartridge receiver for a razor blade cartridge, that is connected with the base and that is disposed at the opening at the upper end of the base. The cartridge receiver has a perimeter and the opening at the upper end of the base completely surrounds the perimeter of the cartridge receiver. The hollow space of the base is adapted for containing a shaving preparation, such as a soap cake, a liquid soap, shaving cream or a body wash and may be combined with skin beneficial ingredients and/or scent. In one embodiment, the body of the shaving assembly includes an adjusting element so that an adequate supply of the shaving preparation may be supplied completely around the perimeter of the cartridge receiver. In other embodiments, the shaving assembly includes a resilient element for urging the shaving preparation toward the upper end of the body. The cartridge receiver may also be movable for changing the position of the razor blade relative to the shaving preparation. The shaving assembly may also include a razor embedded in a mass of shaving preparation so that the cutting blades of the razor lie in substantially the same plane as the top surface of the shaving preparation.

14 Claims, 33 Drawing Sheets

U.S. PATENT DOCUMENTS

| | | | | | |
|---|---|---|---|---|---|
| 1,342,028 | A | | 6/1920 | Nordskog | |
| 1,461,680 | A | * | 7/1923 | Root | 401/72 |
| 1,543,387 | A | | 6/1925 | Kawalle | |
| 1,587,279 | A | * | 6/1926 | Burgher | 510/449 |
| 1,744,280 | A | | 1/1930 | Peterson | |
| 1,768,307 | A | | 6/1930 | Bleloch et al. | |
| 1,836,800 | A | | 12/1931 | Hope | |
| 2,183,554 | A | | 12/1939 | Evans | 30/84 |
| 2,614,321 | A | | 10/1952 | Ackeman | |
| 2,653,339 | A | * | 9/1953 | Mureau | 401/52 |
| 2,700,995 | A | * | 2/1955 | Ritter | 241/278.1 |
| 2,839,224 | A | | 6/1958 | Lipka | |
| 2,876,161 | A | * | 3/1959 | Gieshi | 83/22 |
| 3,378,922 | A | | 4/1968 | Schrader et al. | 30/66 |
| 3,477,127 | A | | 11/1969 | Regan | |
| 3,488,764 | A | | 1/1970 | Welsh | 30/50 |
| 3,675,323 | A | | 7/1972 | Braginetz | 30/32 |
| 3,702,026 | A | | 11/1972 | Scholin | |
| 3,703,764 | A | | 11/1972 | Perry | 30/32 |
| 3,703,765 | A | | 11/1972 | Perez | |
| 3,724,070 | A | | 4/1973 | Dorion, Jr. | 30/47 |
| 3,786,563 | A | | 1/1974 | Dorion, Jr. et al. | 30/50 |
| 3,832,774 | A | | 9/1974 | Perry | 30/32 |
| 3,871,077 | A | | 3/1975 | Nissen et al. | |
| 3,895,437 | A | | 7/1975 | DiBuono | |
| 3,934,338 | A | | 1/1976 | Braginetz | 30/47 |
| 3,935,639 | A | | 2/1976 | Terry et al. | |
| 3,969,817 | A | | 7/1976 | DiBuono | |
| 4,074,429 | A | | 2/1978 | Roberts | |
| 4,170,821 | A | | 10/1979 | Booth | |
| 4,241,500 | A | | 12/1980 | Iten | |
| 4,314,404 | A | | 2/1982 | Ruiz et al. | 30/41 |
| 4,336,651 | A | | 6/1982 | Caro | 30/49 |
| 4,389,773 | A | | 6/1983 | Nissen et al. | 30/50 |
| 4,407,067 | A | | 10/1983 | Trotta | 30/50 |
| 4,442,598 | A | | 4/1984 | Jacobson | 30/47 |
| 4,443,940 | A | | 4/1984 | Francis et al. | 30/50 |
| 4,483,068 | A | | 11/1984 | Clifford | |
| 4,534,110 | A | | 8/1985 | Glass | 30/346.57 |
| 4,535,537 | A | | 8/1985 | Ferraro et al. | 30/32 |
| 4,562,644 | A | | 1/1986 | Hitchens | |
| 4,573,266 | A | | 3/1986 | Jacobson | 30/41 |
| 4,586,255 | A | | 5/1986 | Jacobson | 30/41 |
| 4,595,124 | A | | 6/1986 | Duval et al. | |
| 4,621,424 | A | | 11/1986 | Jacobson | 30/41 |
| 4,624,051 | A | | 11/1986 | Apprille, Jr. et al. | 30/50 |
| 4,712,300 | A | | 12/1987 | Hemmeter | |
| D298,068 | S | | 10/1988 | Gilder | D28/47 |
| 4,807,360 | A | | 2/1989 | Cerier et al. | 30/49 |
| 4,875,288 | A | | 10/1989 | Trotta et al. | 30/49 |
| 4,893,641 | A | | 1/1990 | Strickland | |
| 4,901,437 | A | | 2/1990 | Iten | 30/50 |
| 4,944,090 | A | | 7/1990 | Sumnall | |
| 4,964,214 | A | | 10/1990 | Welsh et al. | |
| 4,970,784 | A | | 11/1990 | Althaus et al. | 30/89 |
| 4,977,670 | A | | 12/1990 | Iten | |
| 4,979,298 | A | | 12/1990 | Pesiri | |
| 4,984,365 | A | | 1/1991 | Leonard et al. | |
| 5,005,287 | A | | 4/1991 | Ritter | 30/41 |
| 5,031,318 | A | | 7/1991 | Brown et al. | |
| 5,063,669 | A | | 11/1991 | Althaus | 30/77 |
| 5,084,968 | A | | 2/1992 | Trotta | 30/47 |
| 5,121,541 | A | | 6/1992 | Patrakis | |
| 5,134,775 | A | | 8/1992 | Althaus et al. | |
| 5,141,349 | A | | 8/1992 | Maguire, Jr. et al. | |
| 5,161,307 | A | | 11/1992 | Althaus | 30/77 |
| 5,191,712 | A | | 3/1993 | Crook et al. | 30/34.2 |
| 5,209,925 | A | * | 5/1993 | Lindauer et al. | 424/73 |
| 5,249,361 | A | | 10/1993 | Apprille, Jr. et al. | 30/77 |
| 5,265,759 | A | | 11/1993 | Coffin | 221/123 |
| 5,319,852 | A | | 6/1994 | Metzger | |
| 5,369,885 | A | | 12/1994 | Ferraro | 30/41 |
| 5,430,939 | A | | 7/1995 | Johnston | 30/41 |
| 5,461,782 | A | | 10/1995 | Rauch | |
| 5,463,813 | A | | 11/1995 | Otsuka et al. | 30/43.9 |
| 5,490,329 | A | | 2/1996 | Chylinski et al. | |
| 5,493,778 | A | | 2/1996 | Ichivanaoi | |
| 5,497,550 | A | | 3/1996 | Trotta et al. | 30/50 |
| D373,218 | S | | 8/1996 | Shurtleff et al. | D28/47 |
| 5,579,580 | A | | 12/1996 | Althaus et al. | |
| 5,604,983 | A | | 2/1997 | Simms et al. | |
| 5,666,729 | A | | 9/1997 | Ferraro | 30/50 |
| D397,507 | S | * | 8/1998 | Bern | D28/8.1 |
| D403,811 | S | | 1/1999 | Brown et al. | D28/47 |
| 5,953,825 | A | | 9/1999 | Christman et al. | 30/527 |
| D415,315 | S | | 10/1999 | Swanson et al. | D28/47 |
| 6,039,483 | A | * | 3/2000 | Szekely | 401/50 |
| 6,161,287 | A | | 12/2000 | Swanson et al. | |
| 6,185,823 | B1 | | 2/2001 | Brown et al. | |
| 6,295,734 | B1 | | 10/2001 | Gilder et al. | 30/50 |
| 6,298,557 | B1 | | 10/2001 | Gilder | 30/34.2 |
| 6,298,558 | B1 | | 10/2001 | Tseng et al. | 30/41 |
| 6,308,416 | B1 | | 10/2001 | Bosy et al. | 30/50 |
| 6,502,318 | B1 | | 1/2003 | Gilder | 30/530 |

FOREIGN PATENT DOCUMENTS

| | | |
|---|---|---|
| DE | 319832 | 2/1919 |
| DE | G 87 17 729.3 | 9/1989 |
| EP | 0 276 066 | 1/1988 |
| EP | 0 477 132 B1 | 3/1992 |
| EP | 0 453 906 B1 | 11/1992 |
| EP | 1 125 697 A1 | 8/2001 |
| FR | 482 302 | 3/1917 |
| FR | 806 899 | 12/1936 |
| FR | 1484360 | 6/1967 |
| FR | 1 503 887 | 12/1967 |
| GB | 409 902 | 5/1934 |
| GB | 1 432 182 | 4/1976 |
| GB | 1 572 442 | 7/1980 |
| GB | 2 042 959 A | 10/1980 |
| GB | 2116470 | 9/1983 |
| JP | 4-361783 | 12/1992 |
| WO | WO 91/01204 | 2/1991 |
| WO | WO 96/02369 | 2/1996 |
| WO | 98/36878 | 8/1998 |

* cited by examiner

520

1020

SHAVING PREPARATION FOR WET SHAVING ASSEMBLY

This application is a Divisional Application of U.S. Ser. No. 09/505,408 entitled "Wet Shaving Assembly", filed on Feb. 16, 2000 now U.S. Pat. No. 6,584,690, and claims the benefit of the filing date thereof under 35 U.S.C. §121.

FIELD OF THE INVENTION

The present invention is directed to shaving and is particularly directed to a shaving assembly capable of lubricating and shaving a surface in a single stroke.

BACKGROUND OF THE INVENTION

Shaving body hair typically requires the following five steps: (1) wetting a skin surface, (2) preparing and/or dispensing a shaving preparation (e.g., shaving cream), (3) applying the shaving preparation to the skin surface, (4) shaving the skin surface with a blade, and (5) washing away excess shaving preparation remaining on the skin. In order to save time and simplify the shaving process, there have been many efforts directed to combining two or more of the above steps.

U.S. Pat. No. 4,712,300 discloses a razor blade capable of moisturizing and shaving the skin in a single step. The razor blade holder includes a block of sponge-like material having a razor blade assembly implanted therein, whereby the cutting edges of the blades are arranged at or slightly below the surface of the sponge-like block. When wet, the sponge-like block may be pressed lightly on the skin surface and moved in a direction for shaving the skin.

U.S. Pat. No. 4,074,429 discloses a combined assembly for applying lather and moisture to a shaving surface in advance of a razor blade so that the shaving operation can be conducted in a single stroke. This is accomplished by attaching a lathering device, such as a soap cake, immediately in front of the blade of a razor. During a shaving operation, the razor and lathering device are immersed in water and the razor is drawn across a user's skin in an ordinary manner. The position of the lathering device on the razor is such that the soap cake comes into contact with the user's face immediately in advance of the razor blade and thus provides a lubricating composition immediately before shaving. However, the use of the lather-applying assembly requires constant adjustment of the soap cake so that the lubricating substance is properly applied to the shaving surface.

U.S. Pat. No. 4,562,644 discloses a lubricant-applying safety razor including a lubricating member provided in front of a cutting edge of a blade when the razor is moved along a user's skin in a shaving, motion. The lubricating member is an elongated cylindrical roll formed of lubricating compounds and extending substantially across the width of the cutting blade. The lubricating member includes a peripheral surface for engaging the skin of the user to apply a thin lubricating film to the skin.

U.S. Pat. No. 3,895,437 discloses a shaving assembly including a sponge-like element secured to a razor in a position that immediately precedes the advance of the blade. The sponge-like element is maintained in a saturated condition so that upon contact with shaving preparation on a user's face, the shaving preparation is moisturized by the lubrication provided by the sponge-like element.

U.S. Pat. No. 4,944,090 discloses a razor including a soluble body carried by a razor head or cartridge having an elongated razor. The soluble body is movable relative to the razor and is biased through an opening in the razor head by a spring. The soluble body disclosed in the '090 patent does not completely surround the elongated razor. As a result, the device is designed for moving in only one axial direction over a shaving surface and is incapable of adequately lubricating the skin when the razor is moved in multiple directions over a shaving surface.

U.S. Pat. No. 5,141,349 discloses an apparatus for lubricating the blade of a razor by applying a liquid lubricant and solubilizer mixture via an aerosol system directly to the razor blade immediately prior to shaving so that shaving can be performed without first applying a shaving preparation directly to the area to be shaved.

To some extent, the above-mentioned patents have simplified and/or improved the shaving process. However, the shaving devices disclosed in these patents are incapable of operating effectively in certain unique shaving environments, such as when a user attempts to shave while taking a shower or bath.

There are a number of unique problems associated with shaving in a shower. First, the shaving preparation, such as shaving cream, is frequently washed away from the shaving surface before the razor touches the skin. As a result, there is typically little or no lubricant covering the skin or shaving surface during shaving. This makes it difficult, if not impossible, to take advantage of the lubricating properties of a shaving preparation and generally results in an uncomfortable shaving experience. Moreover, individuals who shave while in a shower must often assume awkward and unsafe positions in order to prevent water from washing away the shaving preparation. In addition, shaving in the shower is a rather complex process that requires a shaver to 1) place the razor in a stable location within the shower; 2) apply a shaving preparation to a skin surface; and 3) re-grasp the razor for shaving the skin. The chance that a user will drop the razor during this complex process in significant.

Thus, there is a need for a shaving assembly that allows for efficient and safe shaving in a wet environment, such as a shower or bath. There is also a need for a shaving assembly that incorporates a lubricating shaving preparation with a razor in such a way as to maximize skin lubrication during hair removal. The skin lubrication may contain skin beneficial additives and/or scents. Such a wet razor system should also allow for simultaneous body washing and hair removal, thereby reducing the amount of time spent in the shower or bath.

SUMMARY OF THE INVENTION

One preferred embodiment of the present invention provides a shaving assembly including a base having an upper end, a lower end and a hollow space therebetween. The base has an opening at the upper end and the hollow space is in I communication with the opening. The hollow space is adapted for securing and/or holding a lubricating shaving preparation therein, such as a soap cake, liquid soap, body wash, shaving cream or shaving gel. The base may be made of a broad range of materials such as polymers and metals, and may be either flexible or rigid. In certain embodiments, the base comprises an upper member that includes the hollow space and a lower member capping and/or closing off the bottom portion of the hollow space.

The shaving assembly also preferably includes a cartridge receiver having a perimeter. The cartridge receiver is preferably designed for selectively securing one or more razor blades or razor blade cartridges therein, whereby each razor blade or razor blade cartridge preferably has one or more elongated blades having cutting edges. The cartridge receiver is preferably designed whereby the secured one or more razor blades or razor cartridges therein may or may not be moveable by pivoting, rocking, or combinations thereof. The cartridge receiver is desirably disposed adjacent to or at the opening at the upper end of the base so that the opening completely surrounds the perimeter of the cartridge receiver. The cartridge receiver may also project above the upper end of the base so that the cutting edges of a razor secured in the receiver lie above the upper end of the base.

In certain embodiments, the position of the cartridge receiver may be adjusted using an adjusting element in contact with the base. The cartridge receiver may also be movable by providing a resilient element in contact with the receiver. The resilient element preferably biases the cartridge receiver toward the upper end of the base. In further embodiments, the cartridge receiver may be ratchet mounted to the base. In these particular embodiments, the base includes at least one cartridge receiver leg support having a central opening including teeth and the cartridge receiver includes at least one leg secured in the central opening of the cartridge receiver leg support. The at least one leg of the cartridge receiver engages the teeth of the central opening for selectively ratcheting the cartridge receiver toward the lower end of the base.

In certain preferred embodiments, the shaving assembly includes a resilient element between the base and the shaving preparation for urging the shaving preparation toward the upper end of the base. In other preferred embodiments, the shaving assembly may include an adjusting element in contact with the base and in communication with the shaving preparation for incrementally forcing and/or urging the shaving preparation toward the upper end of the base. The adjusting element may be any device for moving an object through space such as a ratcheting mechanism, a rotatable knob connected to a threaded shaft, a lever, a spring or a rigid shaft.

In operation, the shaving assembly of the present invention supplies a shaving preparation at the opening of the upper end of the base and completely around the perimeter of a razor blade. As a result, a shaving preparation may be applied to a user's skin immediately in advance of the cutting edge of a razor. Thus, a shaving surface may be lubricated and shaven in a single motion. In addition, because the shaving preparation is completely around the perimeter of the cartridge receiver, the shaving assembly may be moved in any direction over the shaving surface. This ability to move the razor in multiple directions is particularly appropriate for today's new safety blades that may be safely moved in any direction over a user's skin surface. Moreover, the shaving preparation and the cutting edges of the blades will preferably lie in a common plane because the height of either the shaving preparation or the blades may be adjusted using an adjusting element or automatically adjusted using a resilient element.

In certain preferred embodiments, the shaving preparation is disposed within the hollow space of the base and may be extended to and/or forced to the opening at the upper end of the base so as to completely surround the perimeter of the cartridge receiver. The shaving preparation may be in the form of a cake, such as a solid cake of soap, having a top surface, a bottom surface and side walls extending therebetween. In one embodiment, the shaving preparation cake has an axial bore extending between the top and bottom surfaces thereof. The axial bore preferably defines a perimeter that is larger than the perimeter of the cartridge receiver so that the cartridge receiver is capable of passing through the axial bore of the cake. The shaving preparation cake may have any shape necessary for fitting securely and/or efficiently into the opening of the base.

The shaving assembly may also have a support element disposed within the hollow space of the base and in contact with the shaving preparation. The support element generally supports and/or urges the shaving preparation toward the opening at the upper end of the base. In one embodiment the support element includes a support ring having a central opening in substantial alignment with an axial bore extending through a cake of the shaving preparation. The central opening and the axial bore of the cake are in substantial alignment so that the support ring and the shaving preparation cake may pass around the perimeter of the cartridge receiver. In other preferred embodiments, the shaving preparation is provided in a fluid form and the support element may include a tight seal between the perimeter of the support element and the interior side walls of the base for preventing the shaving preparation from leaking around the support element as the support element moves toward the upper end of the base.

The shaving assembly may include a resilient element between the base and the support ring for biasing or urging the shaving preparation toward the opening at the upper end of the base. The resilient element may include one or more springs having first ends attached to the base and second ends attached to the support ring. The resilient element may also be a compressible foam or sponge-like element. In other embodiments, the shaving assembly may include a resilient element between the base and the cartridge receiver for urging the cartridge receiver toward the upper end of the base.

The shaving assembly preferably includes an adjusting element in contact with the base so that a user may selectively adjust the position of either the support element and/or the cartridge receiver relative to the upper end of the base. In one embodiment, the adjusting element includes a threaded shaft having a first end connected with the support element and a second end connected with a rotatable knob. The rotatable knob is preferably positioned at the lower end of the base. The knob may be rotated for adjusting the position of the support element within the hollow space of the base so as to adjust the position of the shaving preparation relative to the upper end of the base. In another preferred embodiment, the support element preferably includes a ratcheting mechanism and/or a rack and pinion arrangement in contact with the support element for incrementally adjusting the position of the support element within the hollow space of the base. In this particular embodiment, one of the side walls of the base may have an opening therein for positioning a portion of the adjusting element, such as a button accessible at a side wall of the base. The button may be depressed/engaged for activating the adjusting element so as to change the position of the support element or the cartridge receiver relative to the upper end of the base.

Other preferred embodiments of the present invention provide a shaving assembly including a shaving preparation cake having a first surface with a razor blade and/or razor blade cartridge embedded in the cake. The first surface of the shaving preparation completely surrounds the blades embedded in the cake and at least one of the cutting edges of the razor blades/razor blade cartridge lie in the same plane as the first surface of the cake. The shaving preparation cake preferably has a longitudinal axis and at least one razor blade extends in a direction substantially parallel to the longitudinal axis of the cake.

The shaving assembly may also include a gripping element in contact with one or more surfaces of the shaving preparation cake so that the shaving assembly may be securely and comfortably grasped by a user during a shaving operation. The gripping element is preferably attached to the shaving preparation cake, such as being adhered to the shaving preparation cake. The gripping element may include a non-soluble material such as rubber or foam and may include a textured surface for enhancing the gripability of the element. In certain embodiments, the gripping element is remote from the razor blade/razor blade cartridge. In other embodiments, the gripping element may be deposited over one or more surfaces of the shaving preparation, such as by depositing the gripping element material atop the surfaces of the shaving preparation in a liquid form and then curing the gripping material. The shaving cake may have a substantially oval shape or any other shape desirable for conforming to the various contours of a user's body and providing a comfortable grip. The shaving preparation cake may also include a lubricant and skin beneficial ingredients and/or scents.

In further embodiments, the shaving assembly includes at least one razor blade having a longitudinal axis with one or more wires, molded elements, or die cut elements extending in directions substantially transverse to the longitudinal axis of the blade. The wires, molded elements, or die cut elements extending in a substantially transverse direction relative to the blades allows the blades to be passed over a shaving surface in any direction without cutting or nicking the skin. The transverse wires, molded elements, or die cut elements may overlie the cutting edges. The shaving assembly may also include a mesh overlying the cutting edges of the blades. The mesh allows the blades to pass over the shaving surface in any direction without nicking or cutting the skin.

In further embodiments, the razor blades may be in the form of a metal foil having a number of holes whose periphery are sharpened into one or more cutting edges. The sharpened edges within each hole enables the shaving assembly to not only be moved in multiple directions but also cut hair in multiple directions.

DETAILED DESCRIPTION OF PREFERRED EMBODIMENT

Figure 1:
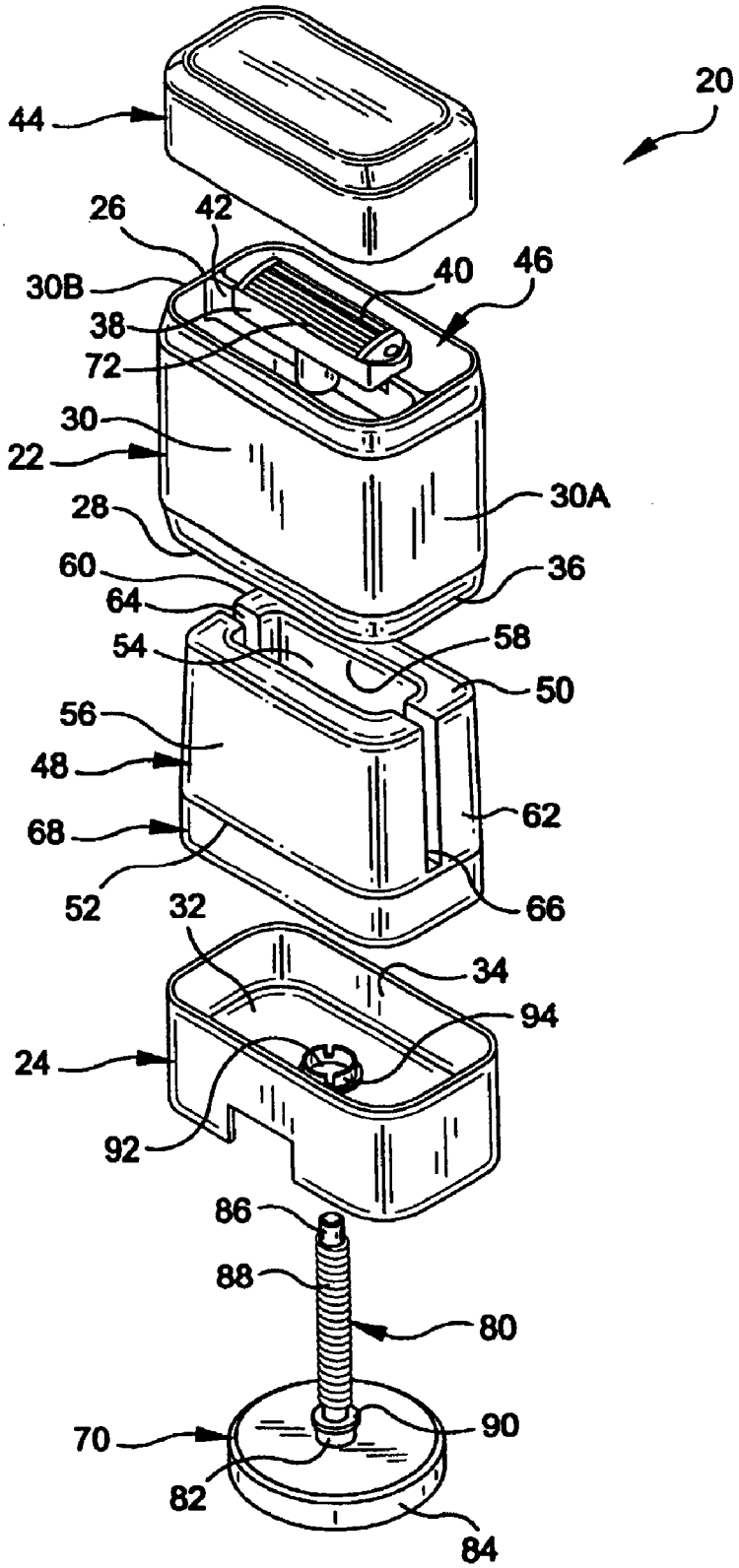
FIG. 1 shows an exploded view of a shaving assembly in accordance with certain preferred embodiments of the present invention.

FIG. 1 shows a shaving assembly 20 in accordance with certain preferred embodiments of the present invention. The shaving assembly includes a base having an upper member 22 and a lower member 24. The upper member 22 of the base has an upper end 26 and a lower end 28 and side walls 30 extending therebetween. The lower member 24 of the base includes a substantially flat surface 32 surrounded by side walls 34 projecting upwardly from the substantially flat surface 32. The upper member 22 includes an area 36 at the lower and thereof having a reduced perimeter. The reduced perimeter area 36 is sized for engaging side walls 34 of lower member 24 so that the upper member 22 and the lower member 24 may be secured together. The shaving assembly also preferably includes a cap 44 secured to the upper end 26 of upper member 22.

The upper member 22 of the base preferably has a cartridge receiver 38 connected thereto. The cartridge receiver 38 is designed for selectively securing a razor blade cartridge 40 therein. The cartridge receiver 38 may be connected to opposing side walls 30A and 30B of the base via a support 42 attached to the side walls 30A and 30B. The side walls 30 of the upper member define a hollow space 46 extending between the upper end 26 and the lower end 28 of the upper member 22. The hollow space 46 extends to an opening at the upper end 26 of the base and completely surrounds the perimeter of the cartridge receiver 38.

The FIG. 1 embodiment shows a cartridge receiver 38 adapted for receiving a razor blade cartridge. The razor blade cartridge may have one or more elongated blades having longitudinal axes and having cutting edges that extend in directions substantially parallel to the longitudinal axes of the one or more blades. In other preferred embodiments, the razor blade cartridge may also include safety blades having wires, molded or die cut safety elements, or mesh that extend in directions substantially perpendicular to the longitudinal axes of the blades. As a result, the razor with safety blades may move safely in any direction relative to a shaving surface and is not limited to movement in one axial direction in order to avoid nicking or cutting a user. In still other embodiments, the razor blade cartridge includes razor blades in the form of a metal foil having a number of holes therein, whereby the periphery of each hole constitutes a cutting edge, as disclosed in U.S. Pat. No. 4,483,068, the disclosure of which is hereby incorporated by reference herein.

In certain preferred embodiments, the shaving assembly includes a shaving preparation 48 disposed within the hollow space 46 of the upper member 22. The shaving preparation may include a cake, a liquid, a cream or a gel. The shaving preparation shown in FIG. 1 is a shaving preparation cake 48 having an upper surface 50, a lower surface 52 and an axial bore 54 extending from the upper surface 50 toward the lower surface 52. The axial bore may extend partway or completely to the bottom surface of the cake. The shaving preparation cake includes a front wall 56, a rear wall 58 and opposed side walls 60 and 62. The side walls 60 and 62 include respective slits 64 and 66 extending from the top surface 50 toward the bottom surface 52. The bottom surface 52 of the shaving preparation cake 48 is molded, casted, or press-fit into the support element 68. The support element 68 has an outer perimeter sized to fit within the hollow space 46 of the base so that the support element may move between the upper end 26 and the lower end 28 of the base. The support element preferably contains tabs or grips to retain the shaving preparation cake.

The shaving assembly 20 also includes an adjusting element 70 for adjusting the position of the shaving preparation cake 48 relative to the cartridge receiver 38 and/or the upper end 26 of the base. The adjusting element 70 is preferably activated so that the top surface 50 of the shaving preparation cake 48 lies in a substantially common plane as the blades 72 of a razor blade cartridge 40 secured in the cartridge receiver 38.

Figure 2A:
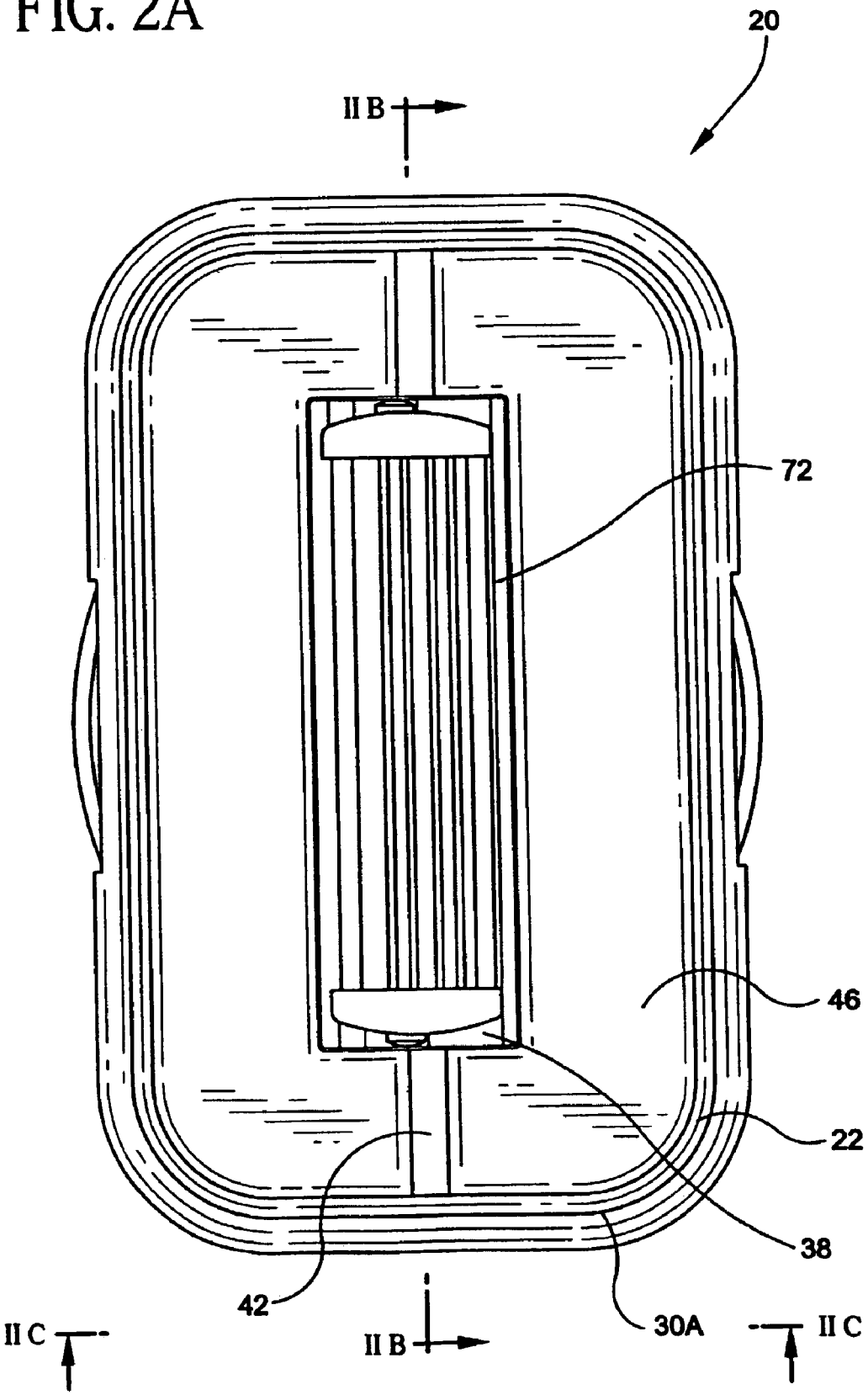
FIG. 2A shows a top view of the shaving assembly of FIG. 1 after assembly.
Figure 2B:
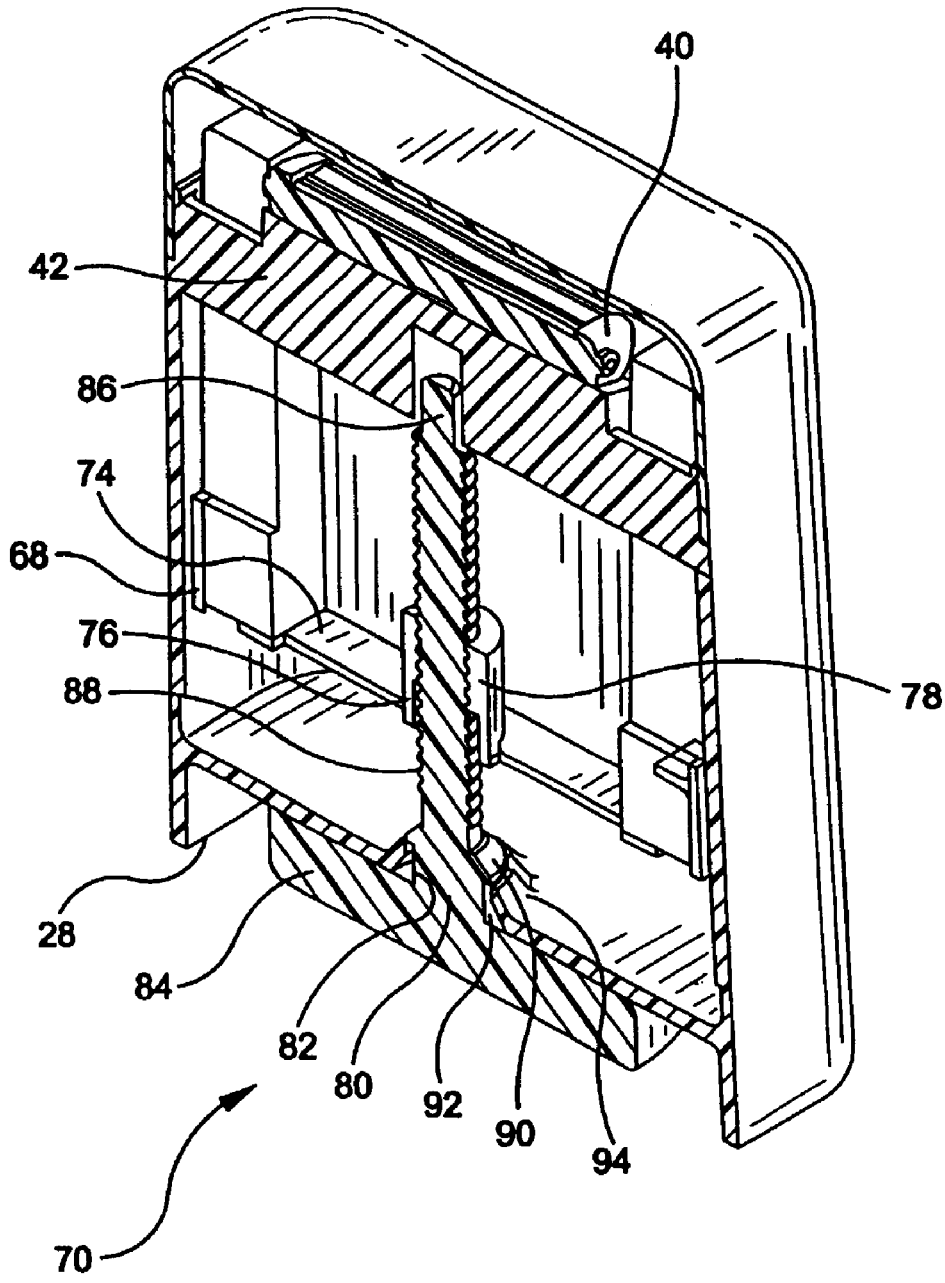
FIG. 2B shows a cross-sectional view of the shaving assembly taken along lines IIB—IIB of FIG. 2A.
Figure 2C:
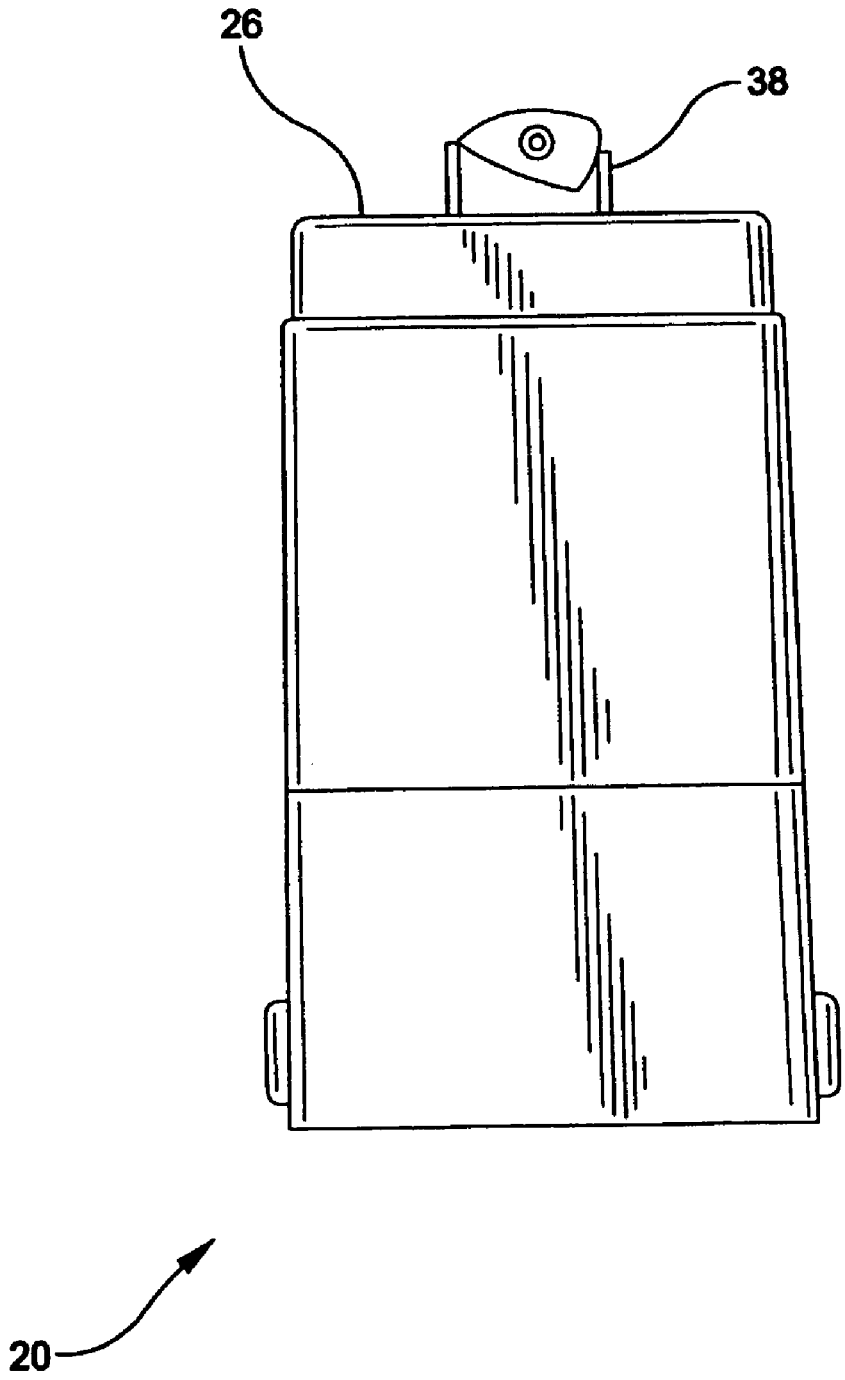
FIG. 2C shows a side view of the shaving assembly taken along lines IIC—IIC of FIG. 2A.

FIG. 2A shows a top view of the shaving assembly 20. The upper member 22 includes opposing side walls 30 defining a hollow space 46 therebetween, the hollow space extending from the upper end to the lower end of the base upper member 22. Referring to FIGS. 2A and 2B, the cartridge receiver 38 is connected with side walls 30A and 30B via support 42 so that the cartridge receiver is disposed at the opening at the upper end of the base. The cartridge receiver has a perimeter 72, whereby the opening at the upper end of the base completely surrounds the perimeter 72. Referring to FIG. 2C, the cartridge receiver 38 projects above the upper end 26 of the base.

Figure 3A:
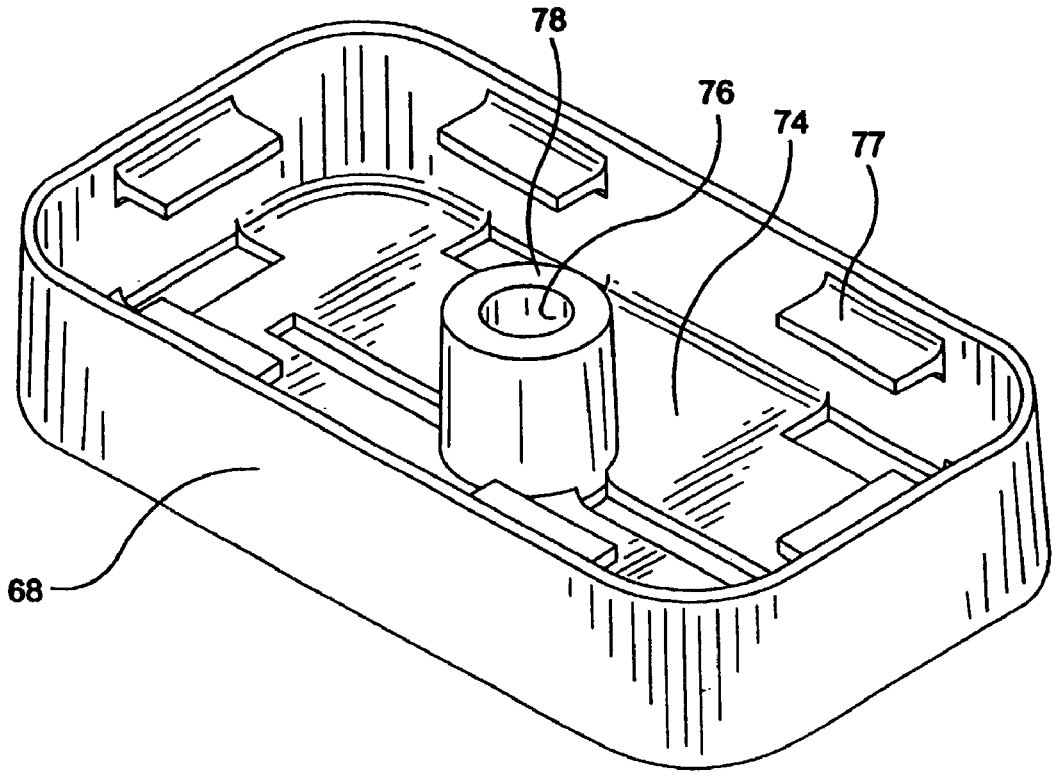
FIG. 3A shows a perspective view of a support element for a shaving preparation, in accordance with certain preferred embodiments of the present invention.
Figure 3B:
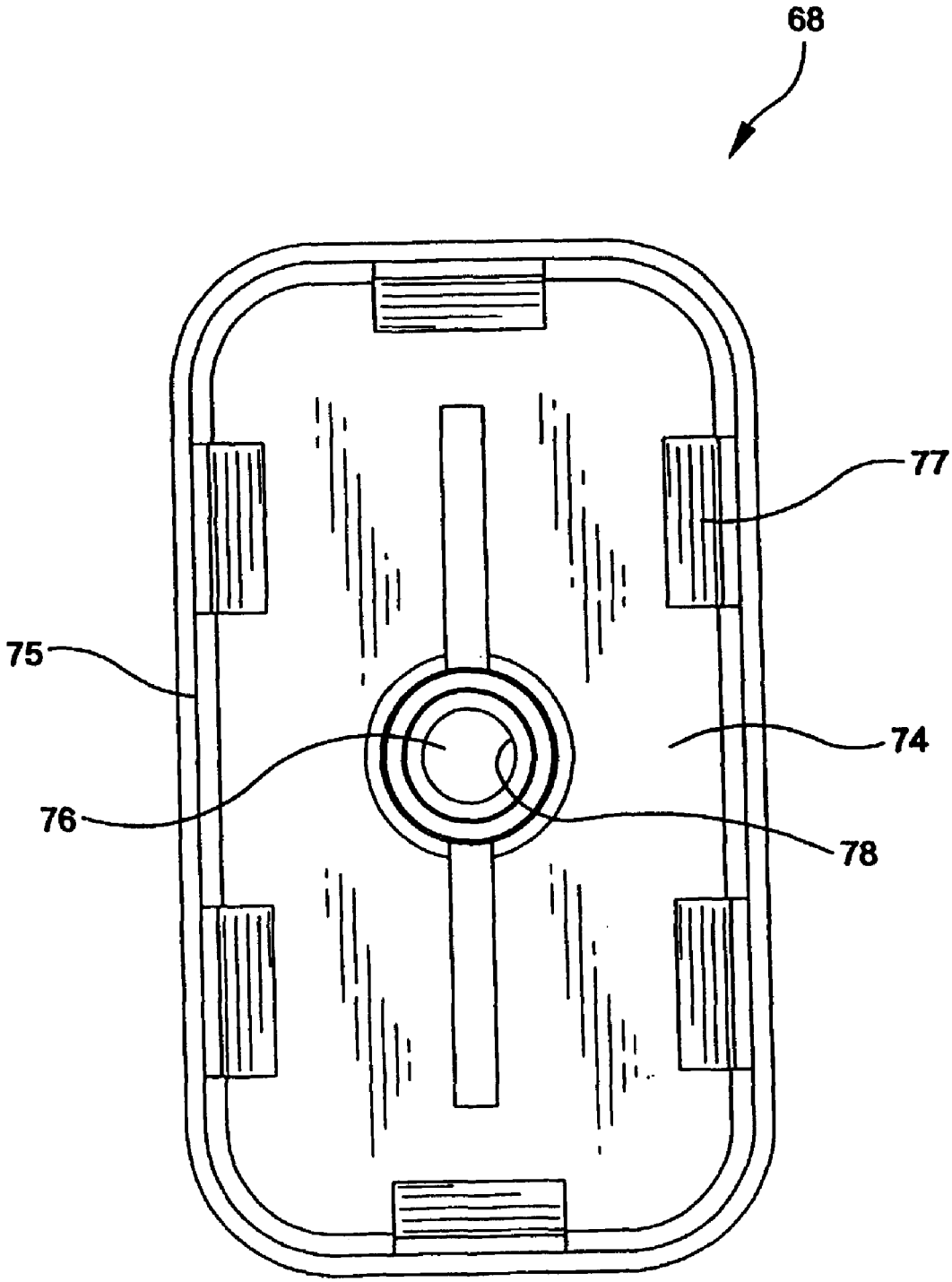
FIG. 3B shows a top view of the support shown in FIG. 3A.

FIG. 3A shows a perspective view of the supporting element 68 adapted for receiving the shaving preparation cake 48 (FIG. 1). The support element 68 includes a substantially flat surface 74 for supporting the bottom surface of the shaving preparation cake and side walls 75 projecting upwardly from the substantially flat surface 74 for laterally securing the shaving preparation. The shaving preparation cake may also be secured to the support element 68 by projecting elements or tab 77 that lock the shaving preparation cake into the tray. The support element 68 includes a bore 76 extending from the substantially flat surface 74 toward the bottom of the support 68. Referring to FIG. 3B, the bore is preferably located in the center of the substantially flat surface 74 and is provided with internal threads 78.

Figure 4A:
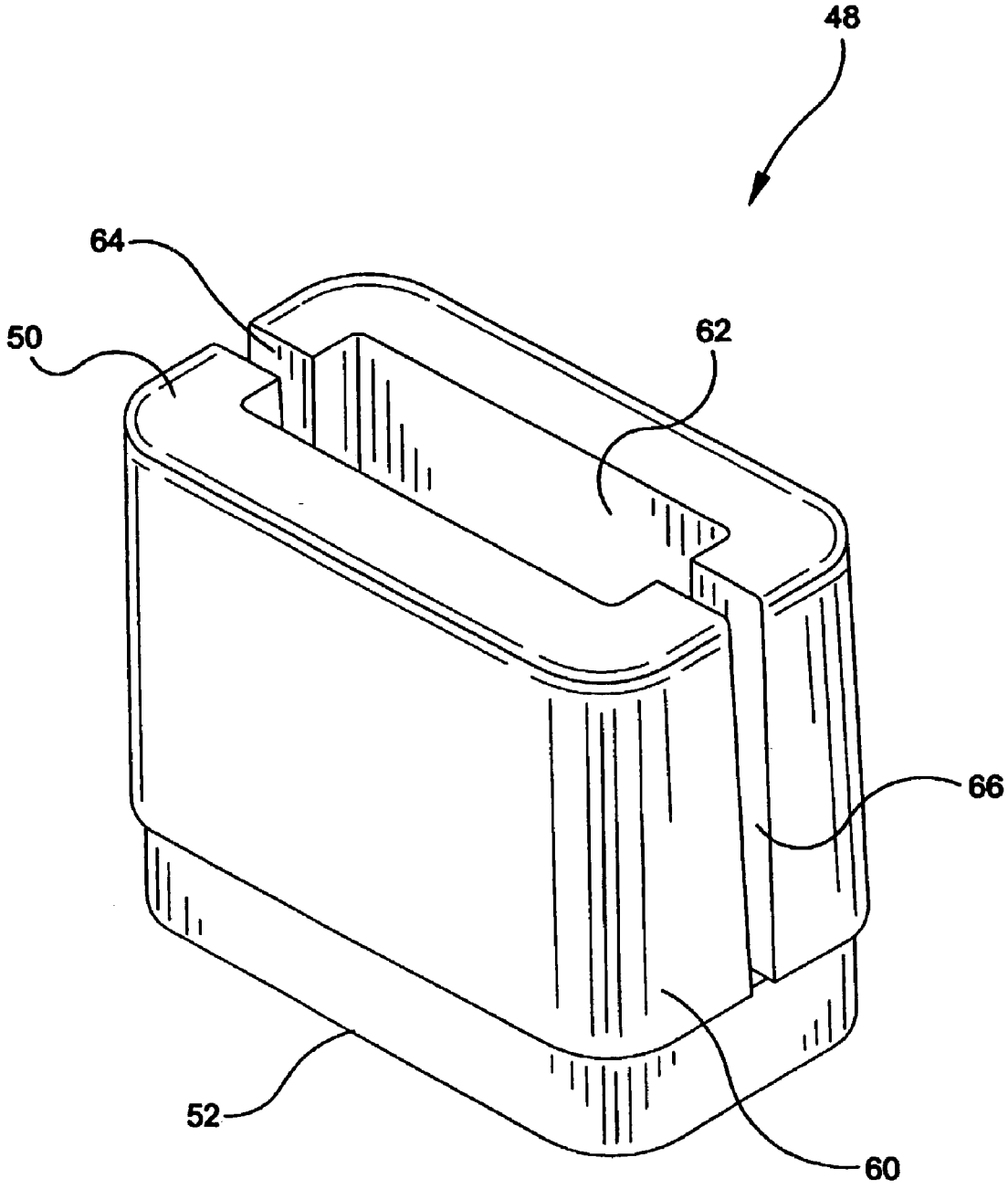
FIG. 4A shows a perspective view of a shaving preparation for use with the shaving assembly of FIG. 1.
Figure 4B:
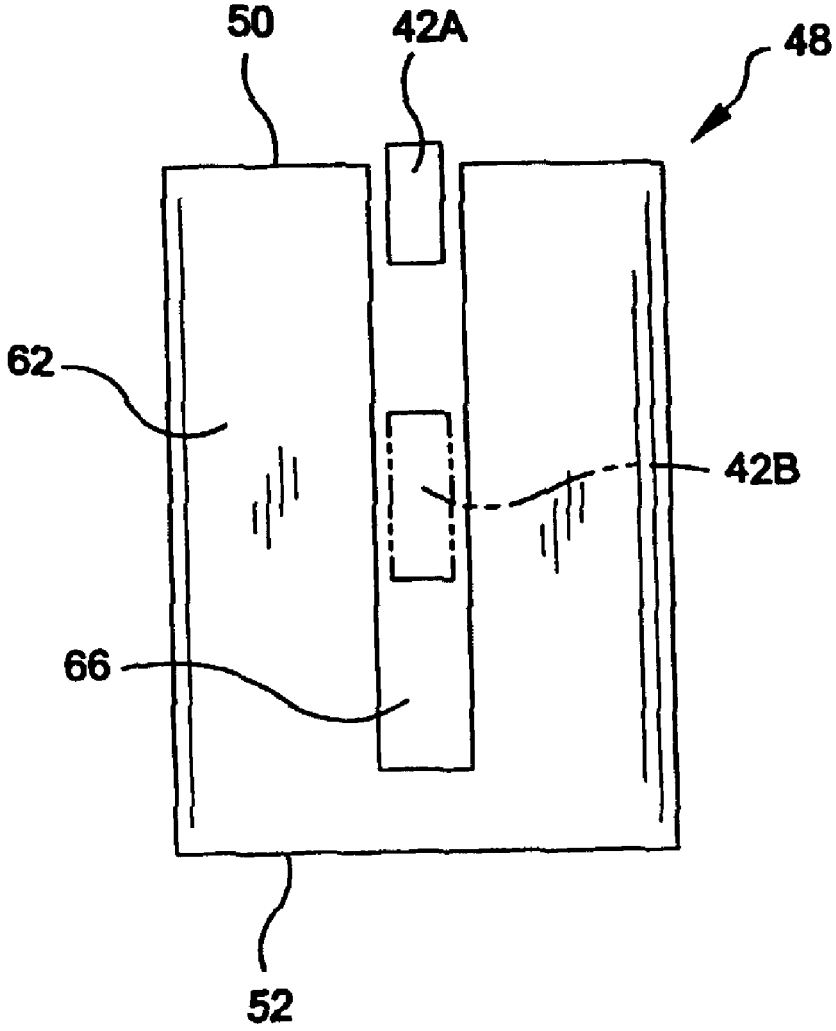
FIG. 4B shows a side view of the shaving preparation of FIG. 4A.
Figure 4C:
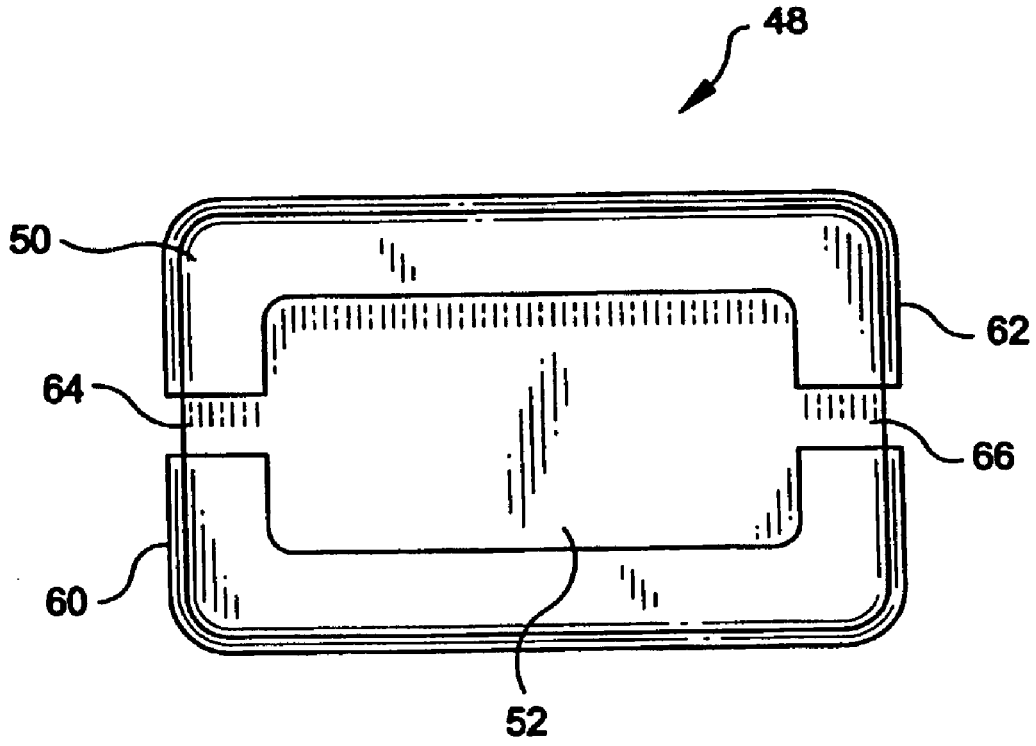
FIG. 4C shows a top view of the shaving preparation shown in FIGS. 4A and 4B.

Referring to FIG. 4A, the shaving preparation cake 48 has a top surface 50 and a bottom surface 52 and side walls 60 and 62. Referring to FIGS. 4B and 4C, the shaving preparation cake 48 includes slits 64, 66 formed in respective side walls 60 and 62. The slits extend from the top surface 50 toward the bottom surface 52 of the cake. The slits 64, 66 enable the shaving preparation cake 48 to pass by the lateral support 42 for the cartridge receiver 38 (FIG. 1) as the shaving preparation cake moves toward the upper end of the base. FIG. 4B shows the lateral support 42 in a first position 42A and a second position 42B relative to slot 66 as the shaving preparation cake 48 moves relative to the cartridge receiver.

Referring to FIG. 1, the adjusting element 70 includes a shaft 80 having a lower end 82 connected to a knob 84 and an upper end 86 remote therefrom. The shaft 80 includes external threads 88 extending between the lower end 82 and the upper end 86 thereof. The shaft also includes an annular flange 90 having an outer diameter greater than the outer diameter of threads 88. The flange 90 is located between the lower end 82 of the shaft 80 and the external threads 88.

Figure 5A:
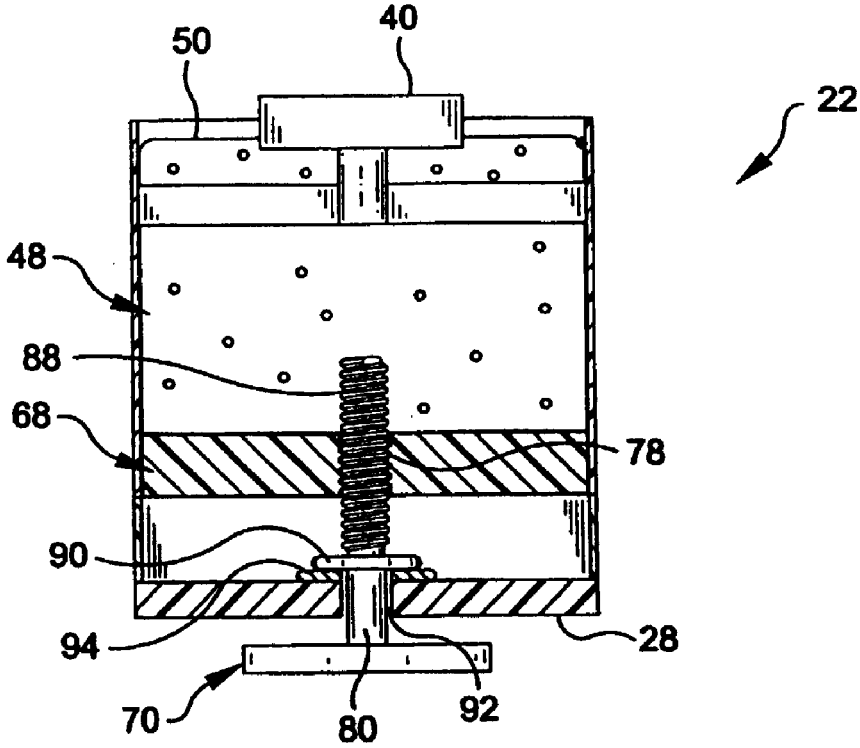
FIG. 5A shows a cross-sectional view of a shaving assembly including a shaving preparation, in accordance with further preferred embodiments of the present invention.

Referring to FIG. 5A, the adjusting member 70 is assembled with the base by passing the threaded portion 88 of shaft 80 through an opening 92 at the lower end 28 of the base. The opening 92 is sized so that the threads 88 of the shaft 80 may pass easily therethrough. The opening 92 includes tabs 94 extending toward the center of the opening 92. The tabs cooperatively define an inner diameter that is less than the diameter of annular flange 90. As a result, the flange 90 may be captured within the hollow space of the base by tabs 94 for rotatably securing adjusting member 70 to the lower end 28 of the base. However, the tabs do not allow the threaded shaft to be withdrawn from the base without applying excessive force to the tabs.

Referring to FIG. 5A, the adjusting member is secured to the lower end of the base by threading the external threads 88 of shaft 80 into the internal threads 78 of opening 76 of support 68. Flange 90 is rotatably secured within opening 92 via tabs 94. During a shaving operation, the shaving preparation 48 may be worn away until the upper surface 50 is below the blades of the razor blade cartridge 40. As a result, shaving preparation is no longer adequately supplied completely around the blades and in advance of the cutting edges.

Figure 5B:
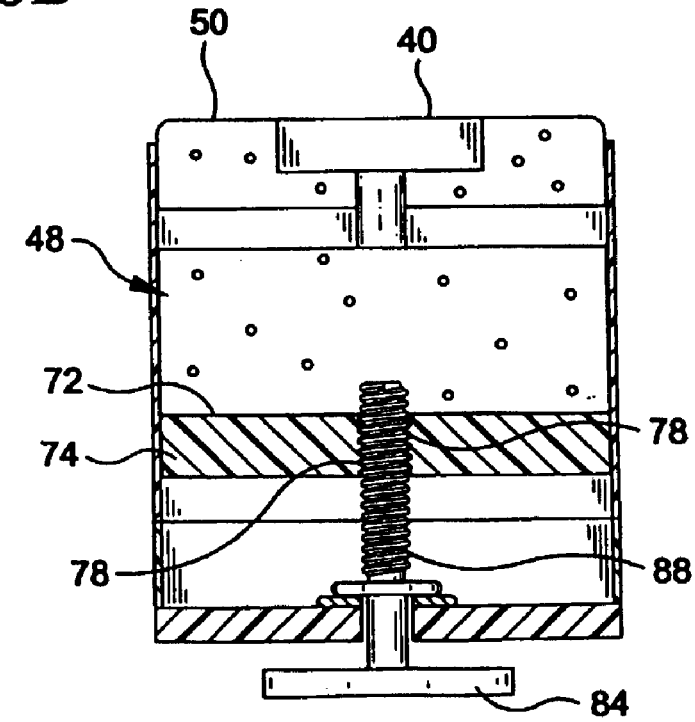
FIG. 5B shows the shaving assembly of FIG. 5A after modifying the position of the shaving preparation.

In order to provide sufficient lubrication, it is necessary to adjust the position of the shaving preparation 48 relative to the razor blade cartridge 40. Referring to FIG. 5B, the shaving preparation 48 is repositioned so that the top surface 50 is substantially in the same plane as the cutting blades of razor blade cartridge 40. The position of the shaving preparation is adjusted by rotating knob 84 which screws the external threads 88 into the internal threads 78 of support element opening 76. As a result, the support element 68 moves toward the razor blade cartridge 40 which forces the shaving preparation 48 to move in an upward direction. The knob 84 is preferably rotated until the top surface 50 of the shaving preparation 48 lies in substantially the same plane as the cutting blades of the razor blade cartridge 40. A user may make fine adjustments with the knob 84 until a visual inspection indicates that the top surface 50 of shaving preparation 48 is substantially in the same plane as the cutting blades.

Figure 6A:
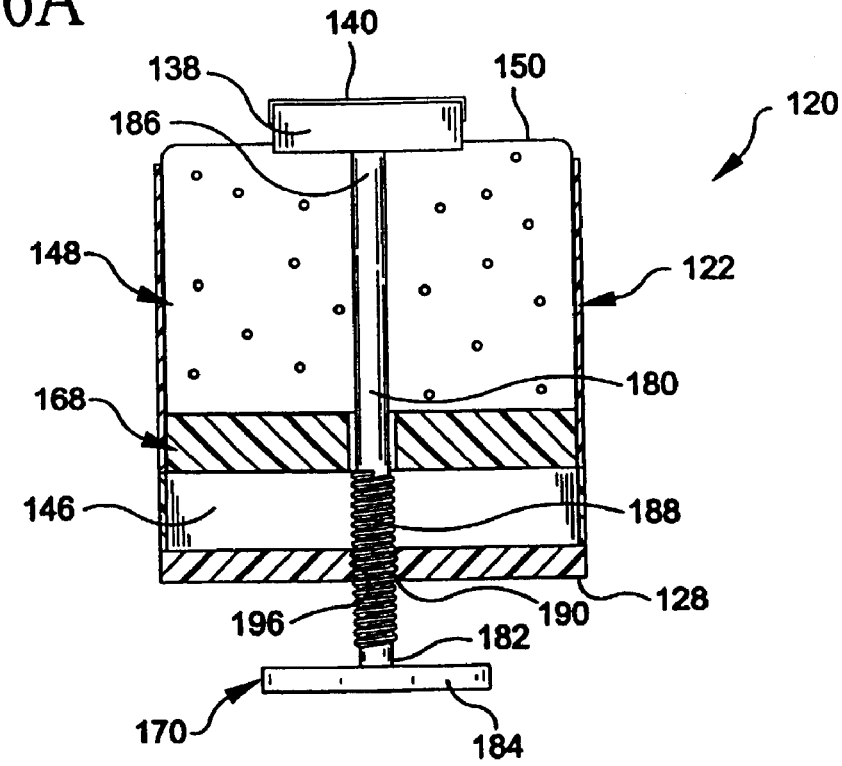
FIG. 6A shows a cross-sectional view of a shaving assembly, including a razor blade cartridge receiver, in accordance with other preferred embodiments of the present invention.
Figure 6B:
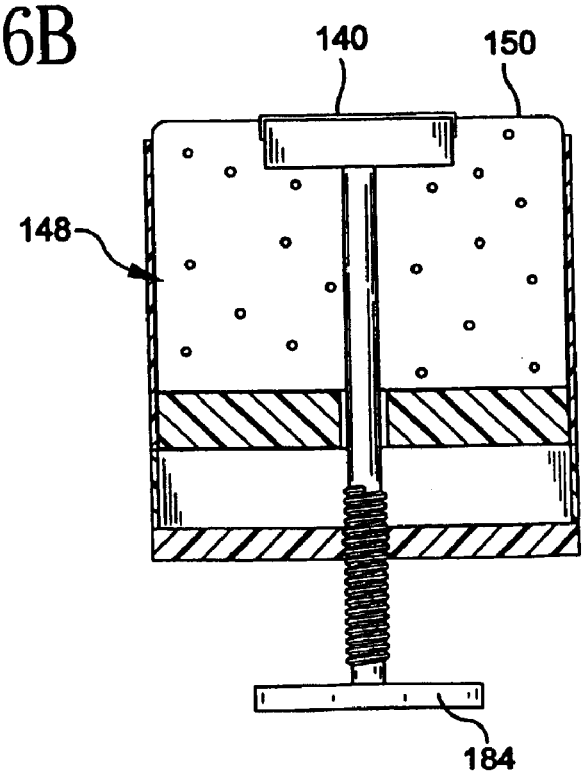
FIG. 6B shows the shaving assembly of FIG. 6A after the position of the razor blade cartridge receiver has been adjusted.

FIGS. 6A and 6B show a shaving assembly in accordance with further preferred embodiments of the present invention whereby the height of the cartridge receiver 138 is adjustable so that the cutting blades of a razor lie in a common plane with a top surface 150 of a shaving preparation 148. The position of the shaving preparation 148 may or may not be adjustable. The shaving assembly 120 includes an adjusting member 170 comprising a rotatable knob 184 attached to a lower end 182 of a shaft 180. The shaft has an upper end 186 connected with the cartridge receiver 138. The shaft 180 includes external threads 188 that may be threaded into internal threads 196 formed in opening 190 at the lower end 128 of base 122. The shaving assembly includes supporting element 168 supporting shaving preparation cake 148. The support element 168 is stationary and does not move within hollow space 146 of the base 122. Shaving preparation cake 148 has an axial bore (not shown) extending from upper surface 150 to support element 168. The axial bore may extend partway or completely to the bottom surface of the cake. The perimeter of the bore is greater than the outer perimeter of the cartridge receiver 138 so that the receiver may pass through the axial bore (not shown) of the shaving preparation 148 during adjustment. During use of the shaving assembly, the top surface 150 of shaving preparation 148 may wear away so that the cutting blades of a razor blade cartridge lie above the top surface 150 of the shaving preparation 148. This will lead to inadequate lubrication of a shaving surface. In order to correct this deficiency and place the cutting blades of the razor blade cartridge 140 in the same plane as the top surface 150 of shaving preparation 148, the knob 184 is rotated so that the external threads 188 of shaft 180 engage the internal threads 196 of opening 190. The knob 184 is rotated until the cutting blades of razor blade cartridge 140 are in the same plane as the top surface 150 of shaving preparation 148. The position of the razor blade cartridge 140 may be continuously readjusted as necessary in order to maintain the cutting blades of the razor blade cartridge 140 in the same plane as the top surface 150 of the shaving preparation.

Figure 6C:
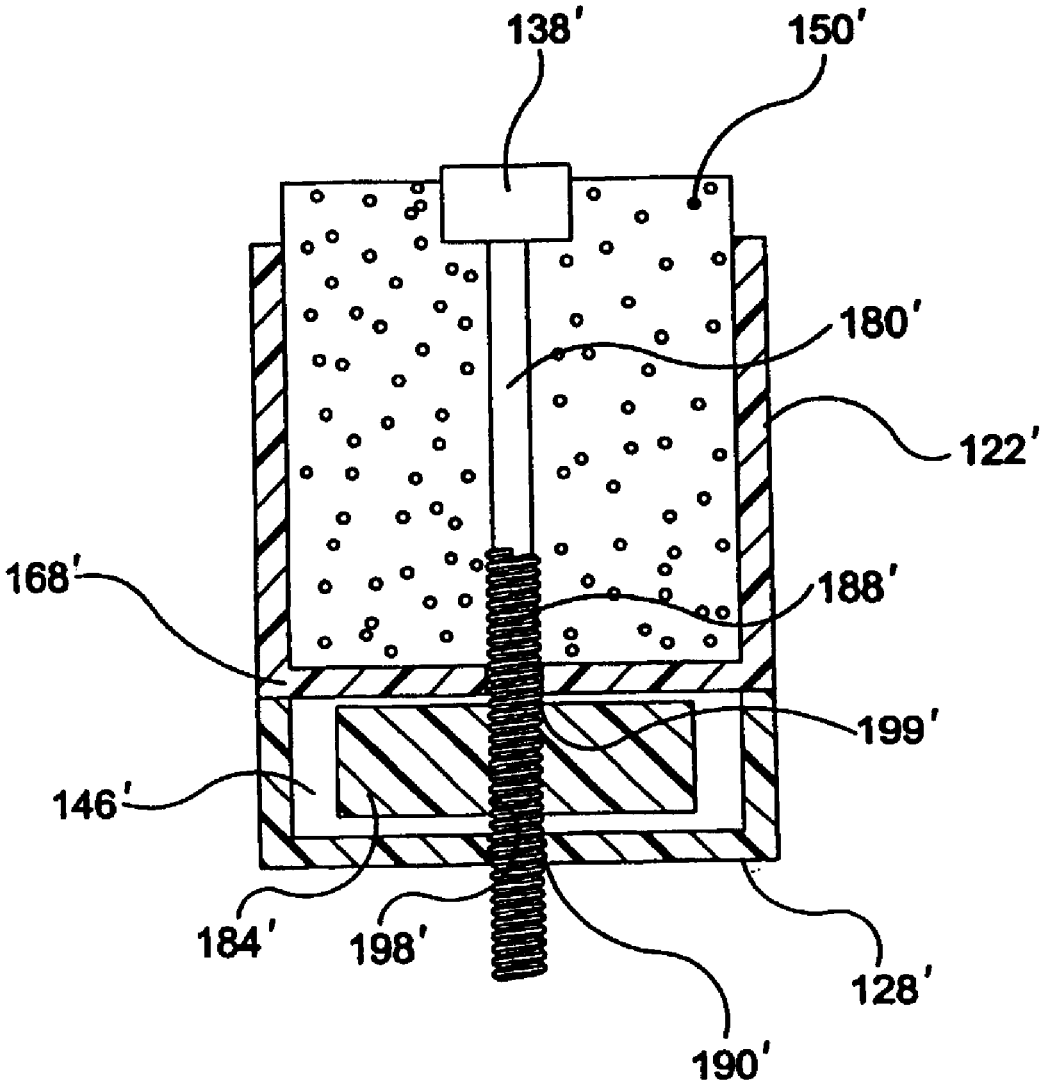
FIG. 6C shows a cross-sectional view of a shaving assembly, in accordance with further preferred embodiments of the present invention.

FIG. 6C shows a shaving assembly similar to that shown in FIGS. 6A and 6B. In this embodiment, the rotatable knob 184' sits within hollow space 146. The shaft 180' has an upper end 186' connected to the cartridge receiver 138' and a lower end 182'. The shaft 180' includes external threads 188' that may be threaded into internal threads 198' formed in opening 199' in the center of rotatable knob 184'. At the lower end 128' of base 122', shaft 180' moves freely through opening 1901.

Figure 7A:
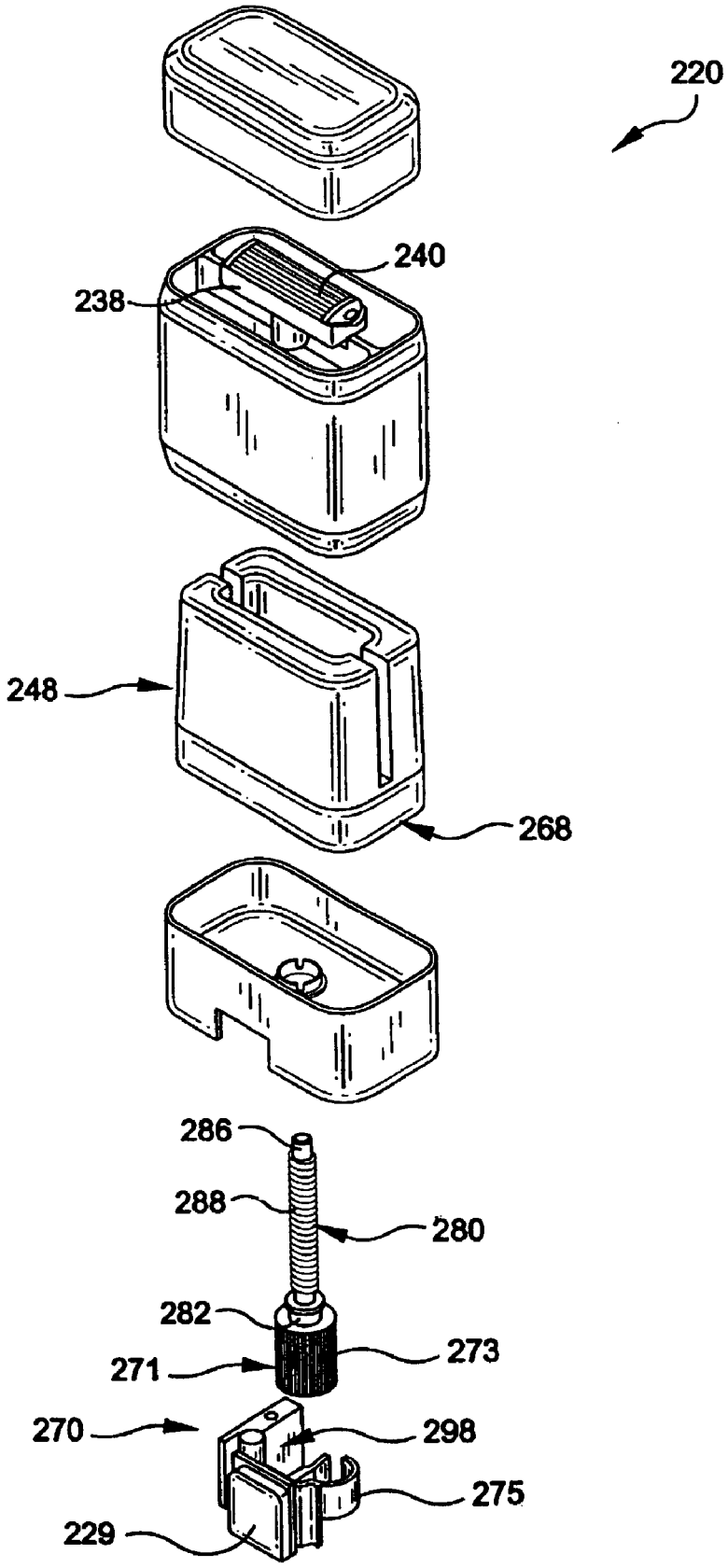
FIG. 7A shows an exploded view of a shaving assembly, in accordance with still further preferred embodiments of the present invention.
Figure 7B:
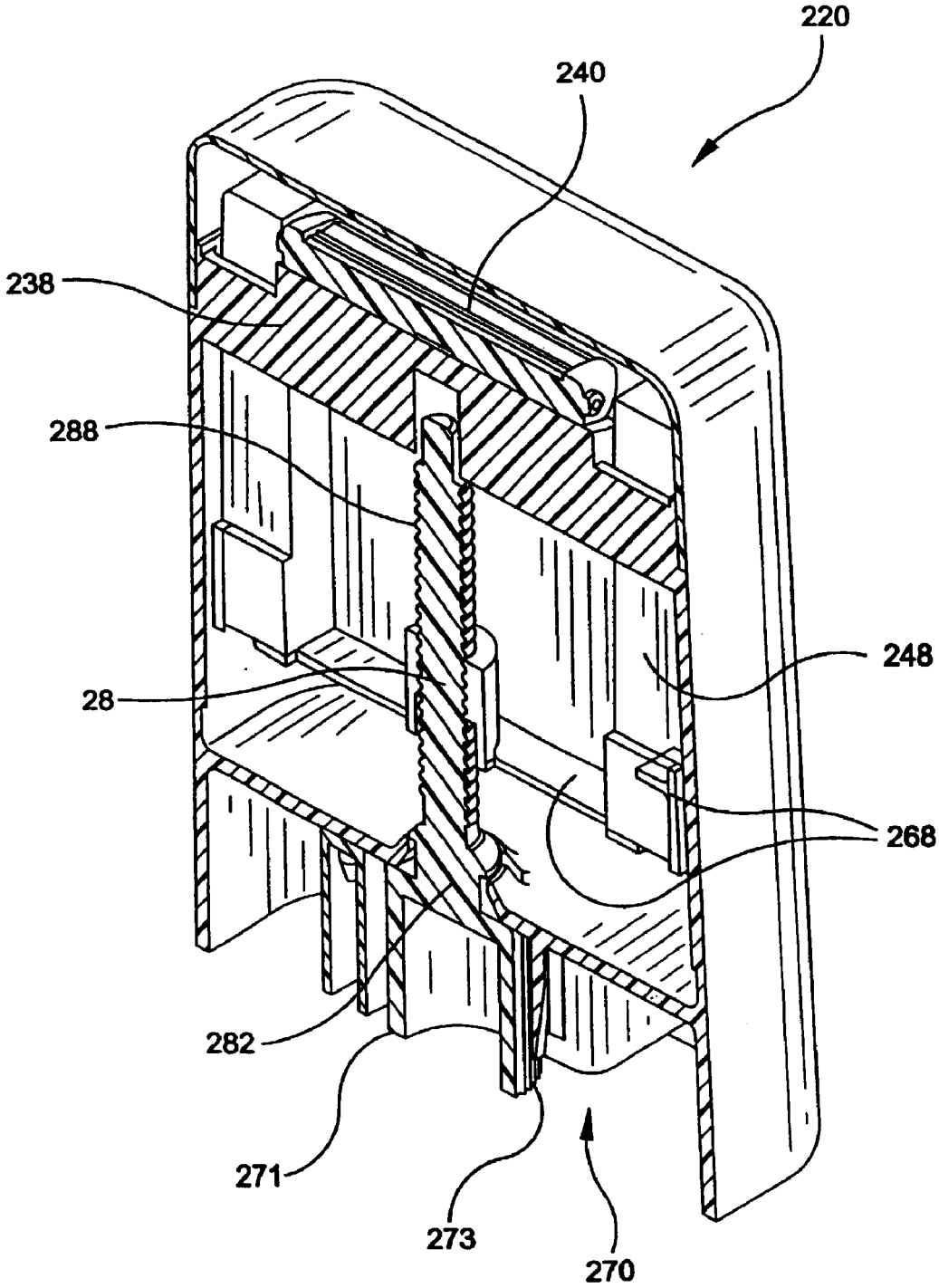
FIG. 7B shows a cross-sectional view of the shaving assembly of FIG. 7A.

FIGS. 7A and 7B show a shaving assembly 220 in accordance with further preferred embodiments of the present invention. The shaving assembly 220 is substantially similar to that shown in FIG. 1, however the shaving assembly includes an adjusting member 270 that incorporates a ratcheting mechanism (FIG. 7C) for adjusting the height of the shaving preparation 248 relative to the razor blade cartridge 240. The adjusting mechanism includes shaft 280 having an upper end 286 attached to cartridge support 238 and a lower end 282 remote therefrom. The adjusting member 270 includes a ratcheting mechanism 298 which engages external threads 288 on shaft 280 for moving support 268 and shaving preparation 248 in an upward direction toward razor blade cartridge 240. The ratcheting mechanism 270 includes a depressible button 229 for incrementally urging the support 268 in an upward direction. In other embodiments, the ratcheting mechanism may be in contact with the cartridge receiver 238 for allowing a user to adjust the height of the cartridge receiver.

Figure 7C:
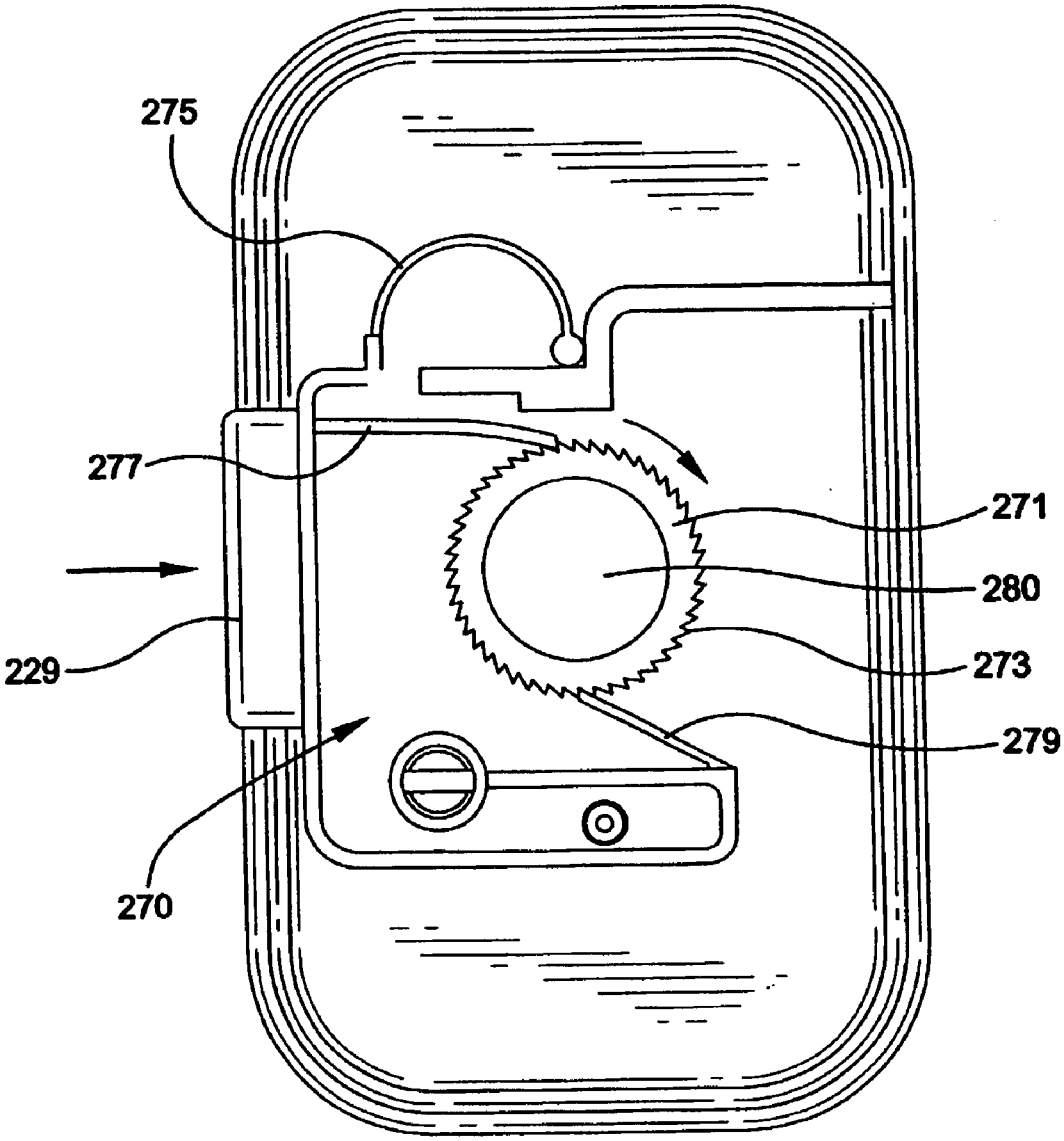
FIG. 7C shows a cross-sectional view of the shaving assembly shown in FIGS. 7A and 7B.

FIG. 7C shows the ratcheting mechanism 270 shown in FIGS. 7A and 7B. the ratcheting mechanism includes a rotatable wheel 271 having teeth 273. The depressible button 229 is connected to a spring 275 that returns the depressible button 229 to an undepressed or start position. The button 229 also includes a lever 277 connected thereto that engages the gear teeth 273 of the ratchet wheel 271 to rotate the wheel when the button 229 is depressed. The ratcheting mechanism also includes an anti-rotating latch 279 that ensures that the wheel 271 is able to turn in only one direction. In operation, the button 229 is depressed for rotating the wheel 271 which, in turn, rotates shaft 280 for moving the shaving preparation 248 in an upward direction.

Figure 8:
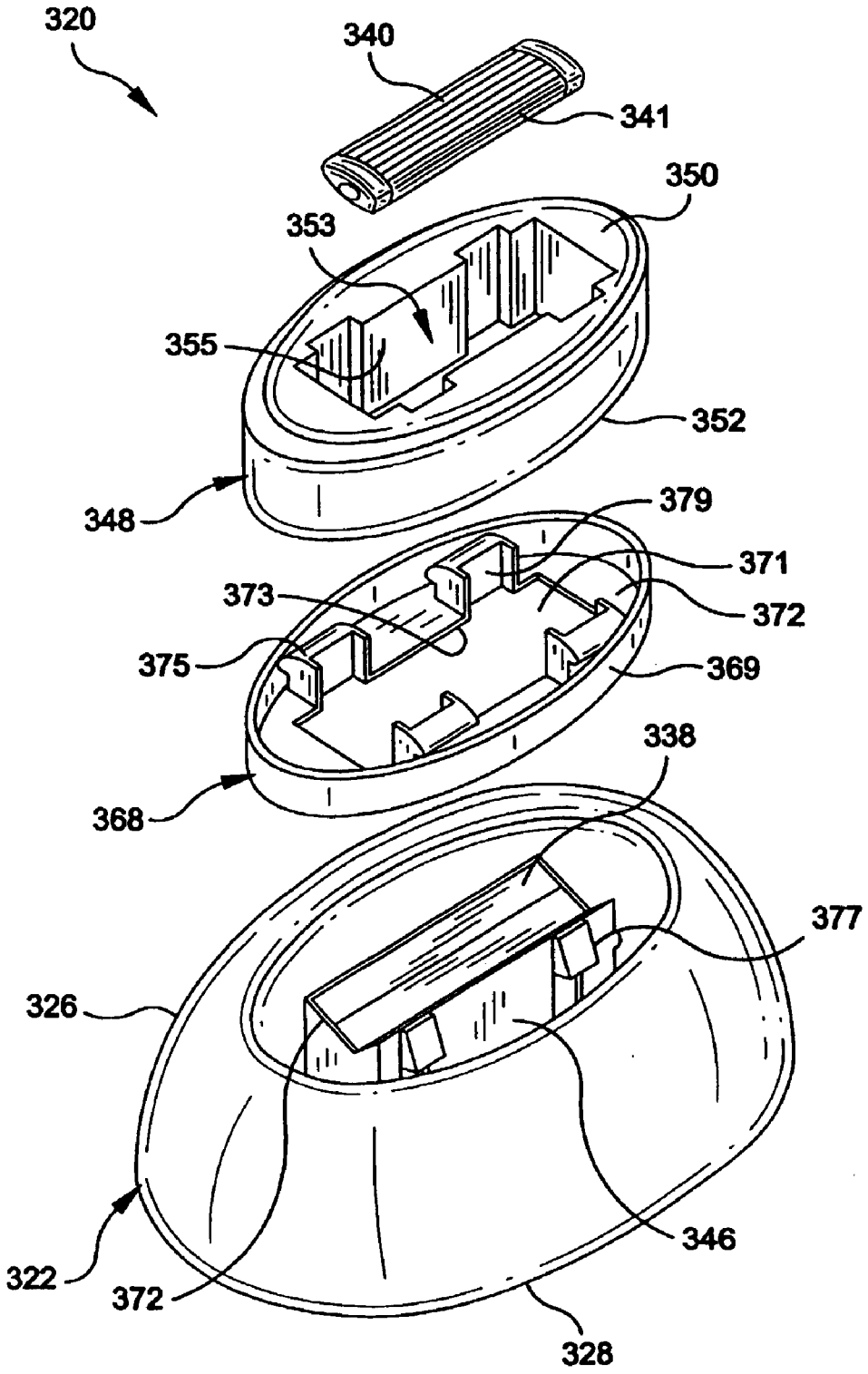
FIG. 8 shows an exploded view of a shaving assembly, in accordance with yet further preferred embodiments of the present invention.

FIG. 8 shows a shaving assembly 320 in accordance with further preferred embodiments of the present invention. The shaving assembly includes a base 322 having an upper end 326 and a lower end 328 and a hollow space 346 therebetween. The shaving assembly 320 includes a cartridge receiver 338 connected to the base 322 and disposed at the opening at the upper end 326 of the base 322. The cartridge receiver 338 has an outer perimeter 372 that is completely surrounded by the opening at the upper end 326 of the base 322. The assembly includes support element 368 for supporting shaving preparation 348. The cartridge receiver 338 is adapted for securing a razor blade cartridge 340 having cutting blades 341. The shaving preparation support 368 has an outer perimeter 369 that is sized to fit within the hollow space 346 of base 322 so that the support element 368 may move in an axial direction between the upper and lower ends 326 and 328 of the base 322. The shaving preparation support includes a central opening 371 having a perimeter 373 that is greater than the perimeter 372 of cartridge receiver 338 so that the shaving preparation support 368 may pass freely over the cartridge receiver 338. The shaving preparation 348 has top surface 350 and bottom surface 352 remote therefrom and an axial bore 353 extending between top surface 350 and bottom surface 352. The shaving preparation support 368 includes one or more tabs 375 for securing the shaving preparation 348 over top surface 372. The perimeter 355 of bore 353 is sized so that the shaving preparation 348 may pass over the perimeter 372 of cartridge receiver 338 during operation of the shaving assembly 320, as will be described in more detail below. The shaving preparation support 368 is captured within the hollow space 346 of the base 322 by projections 377. The projections engage recesses 379 provided on portions of tabs 3375 facing the central opening 371 of support element 368.

Figure 9A:
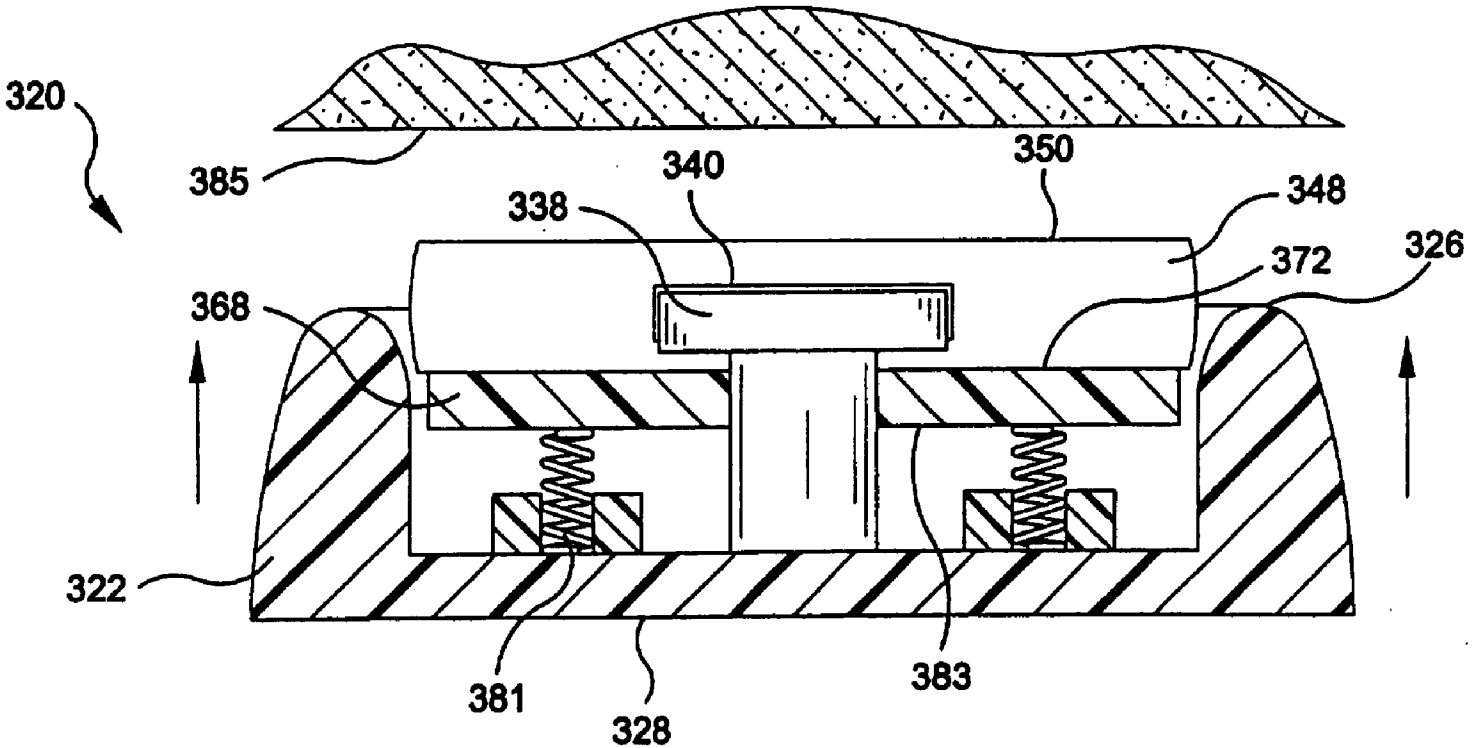
FIG. 9A shows a cross-sectional view of the shaving assembly of FIG. 8 before commencement of a shaving operation.

Referring to FIG. 9A, the shaving assembly 320 includes a resilient element 381 between the bottom surface 383 of support element 368 and the lower end 328 of base 322. The upper surface 372 of support element 368 supports a shaving preparation 348. In the embodiment shown in FIG. 9A, the resilient element 381 includes one or more springs that urge the support element 368 and the shaving preparation 348 toward the upper end 326 of the base 322 for providing lubricant around the cartridge receiver 338. In other embodiments, the one or more springs may be in the form of a leaf spring as shown in FIG. 9C. The leaf spring may be integrally molded with a portion of the shaving assembly 320, such as base 322.

Figure 9B:
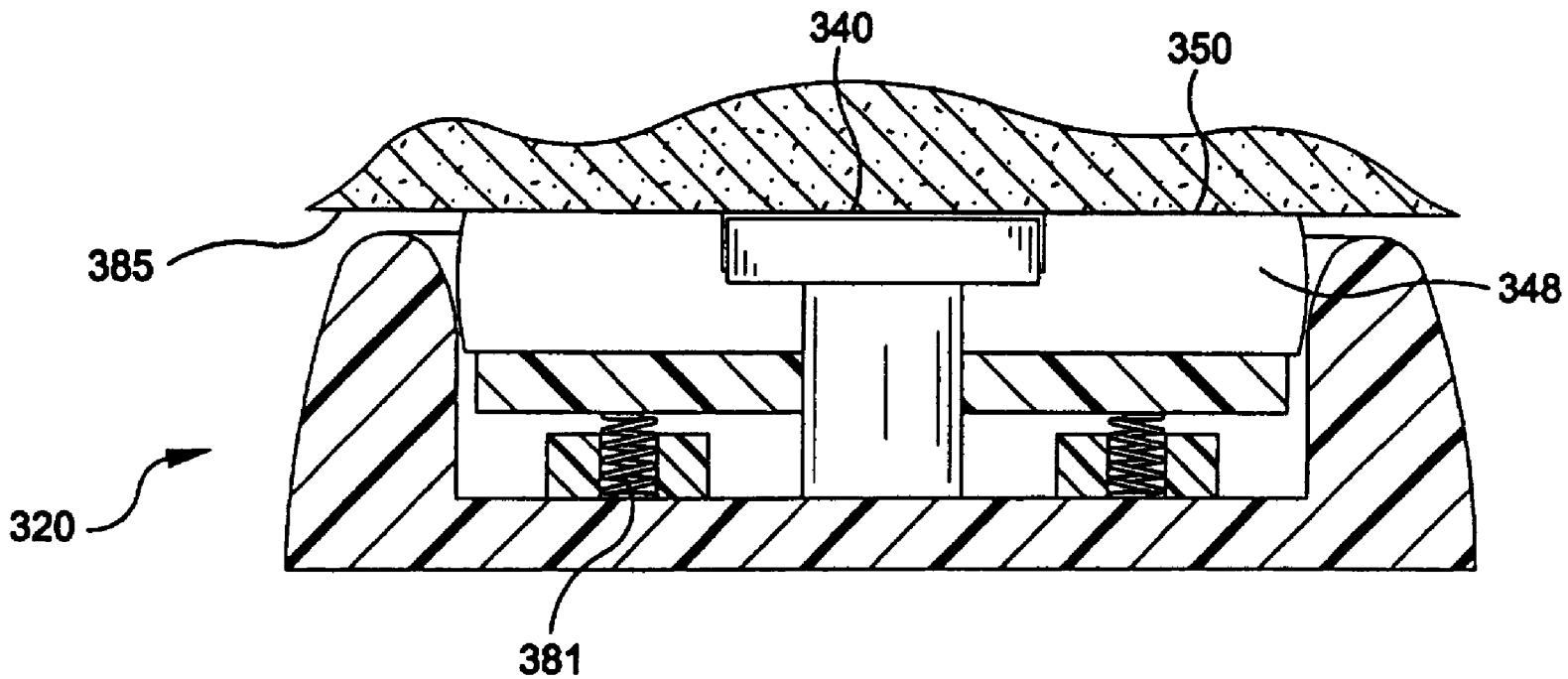
FIG. 9B shows the shaving assembly of FIG. 9A during a shaving operation.
Figure 9C:
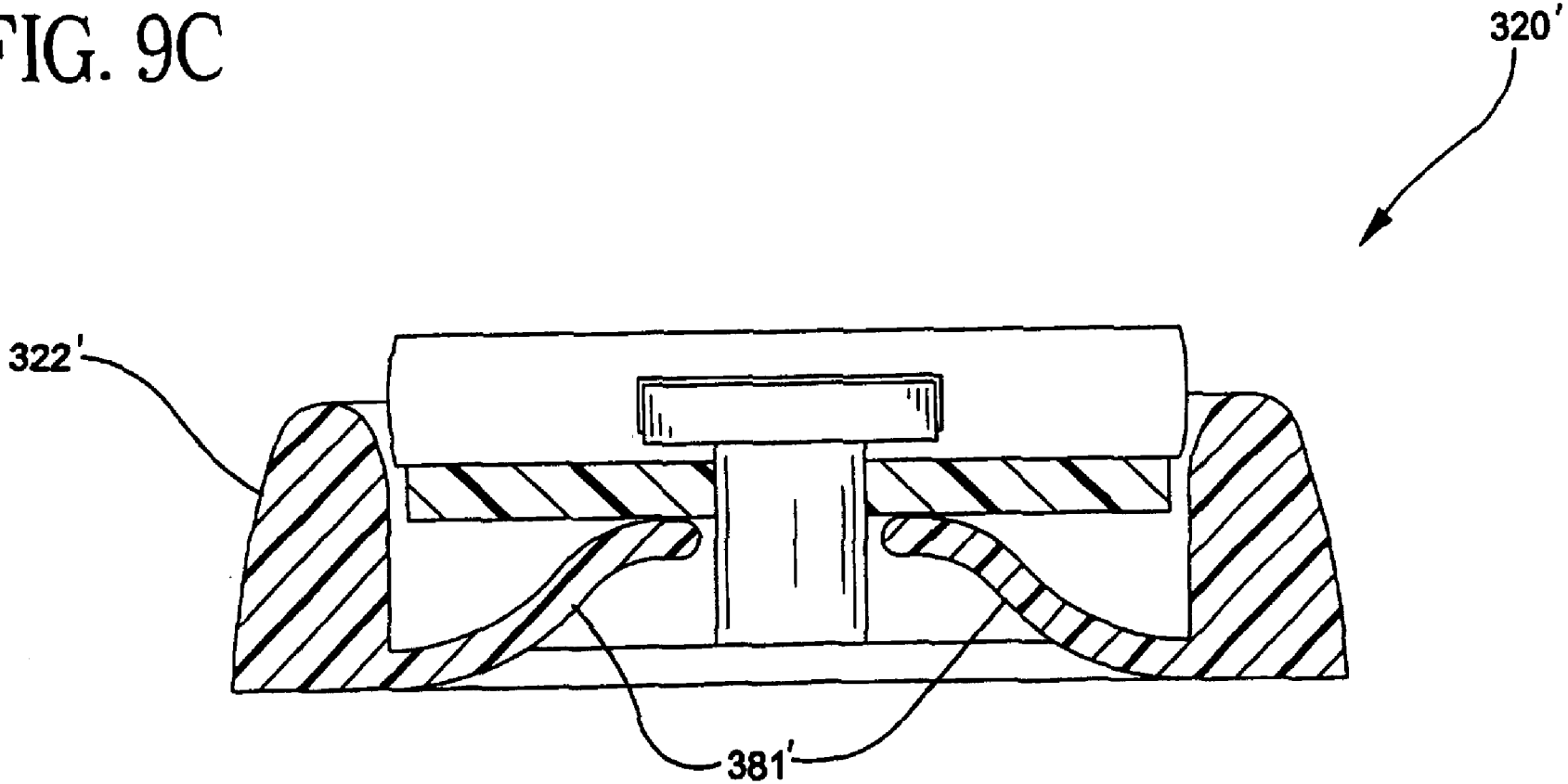
FIG. 9C shows a cross-sectional view of a shaving assembly, in accordance with further preferred embodiments of the present invention.

Referring to FIGS. 9A and 9B, during a shaving operation, the shaving assembly 320 is juxtaposed with a shaving surface so that the top surface 350 of the shaving preparation 348 faces the shaving surface 385. Normally, the one or more springs 381 force the top surface 350 of the shaving preparation 348 above the cartridge receiver 338. However, when the top surface 350 of the shaving preparation 348 contacts the shaving surface 385, the resilient element 381 is compressed until the top surface 350 of the shaving preparation 348 and the cutting blades of the razor blade cartridge 340 lie in a common plane, as shown in FIG. 9B. As a result, the shaving preparation 348 completely surrounds the razor blade cartridge 340 and provides a lubricant to the shaving surface 385 immediately in advance of the cutting blades. During use because shaving preparation 348 sits atop resilient element 381, the shaving preparation 348 is able to undulate in an effort to conform better to the shaving surface.

FIG. 9C shows another embodiment of a shaving assembly 320' that is substantially similar to that shown in FIGS. 9A and 9C. In the FIG. 9C embodiment, the resilient element 381' includes spring leaves that are integrally molded with the base 322.

Figure 10A:
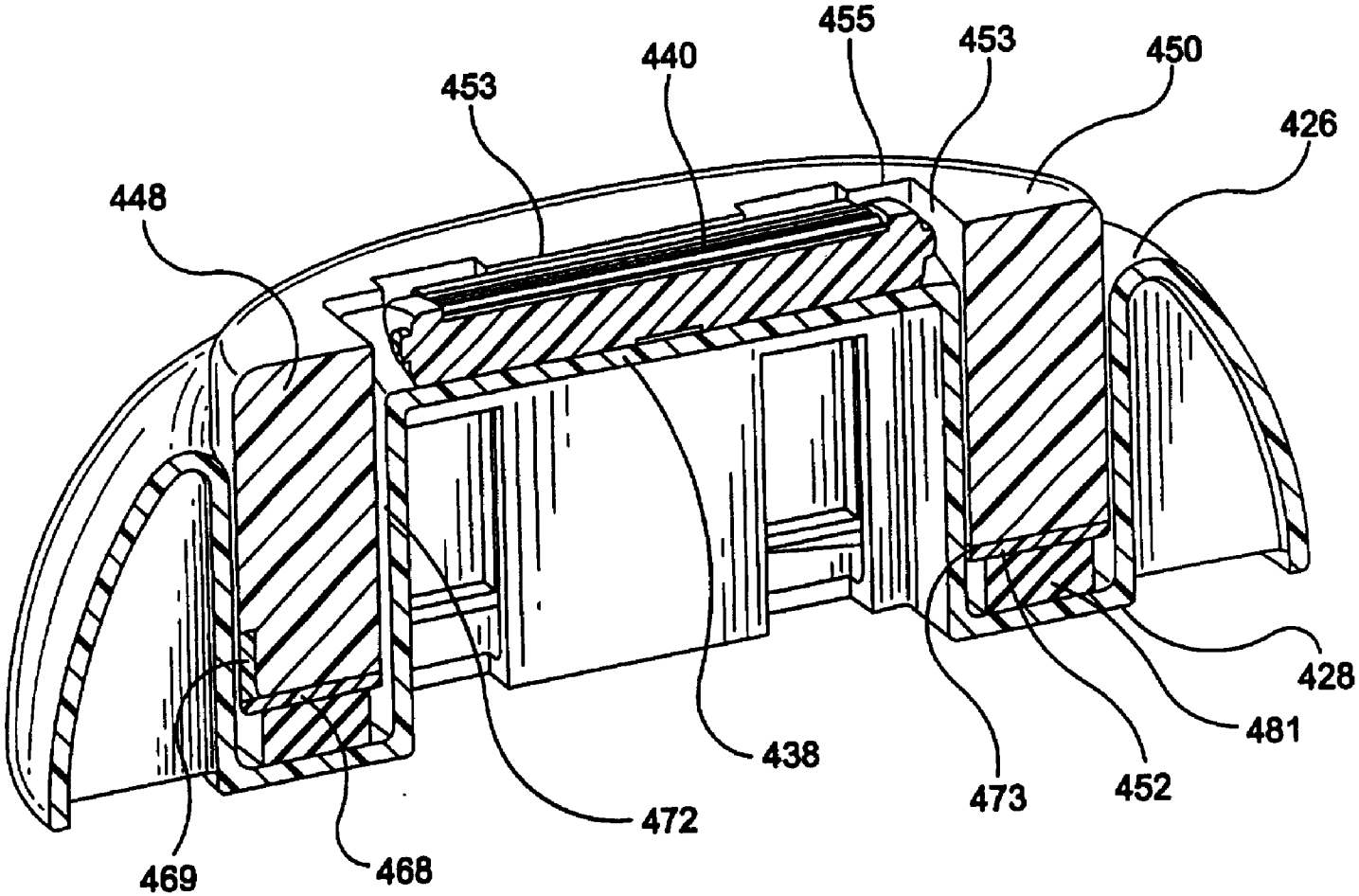
FIG. 10A shows a cross-sectional view of a shaving assembly, in accordance with further preferred embodiments of the present invention.
Figure 10B:
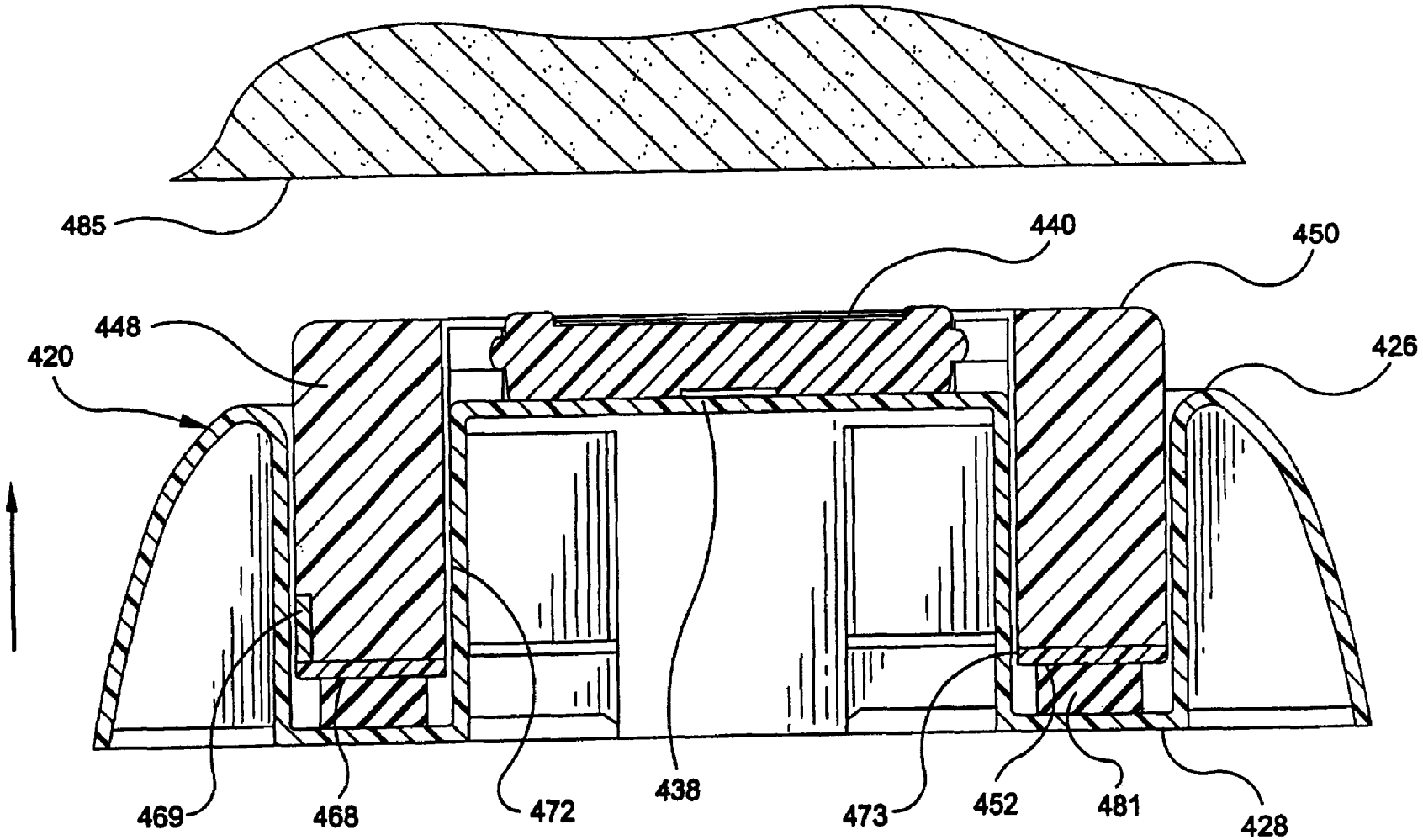
FIG. 10B shows the shaving assembly of FIG. 10A before commencement of a shaving operation.
Figure 10C:
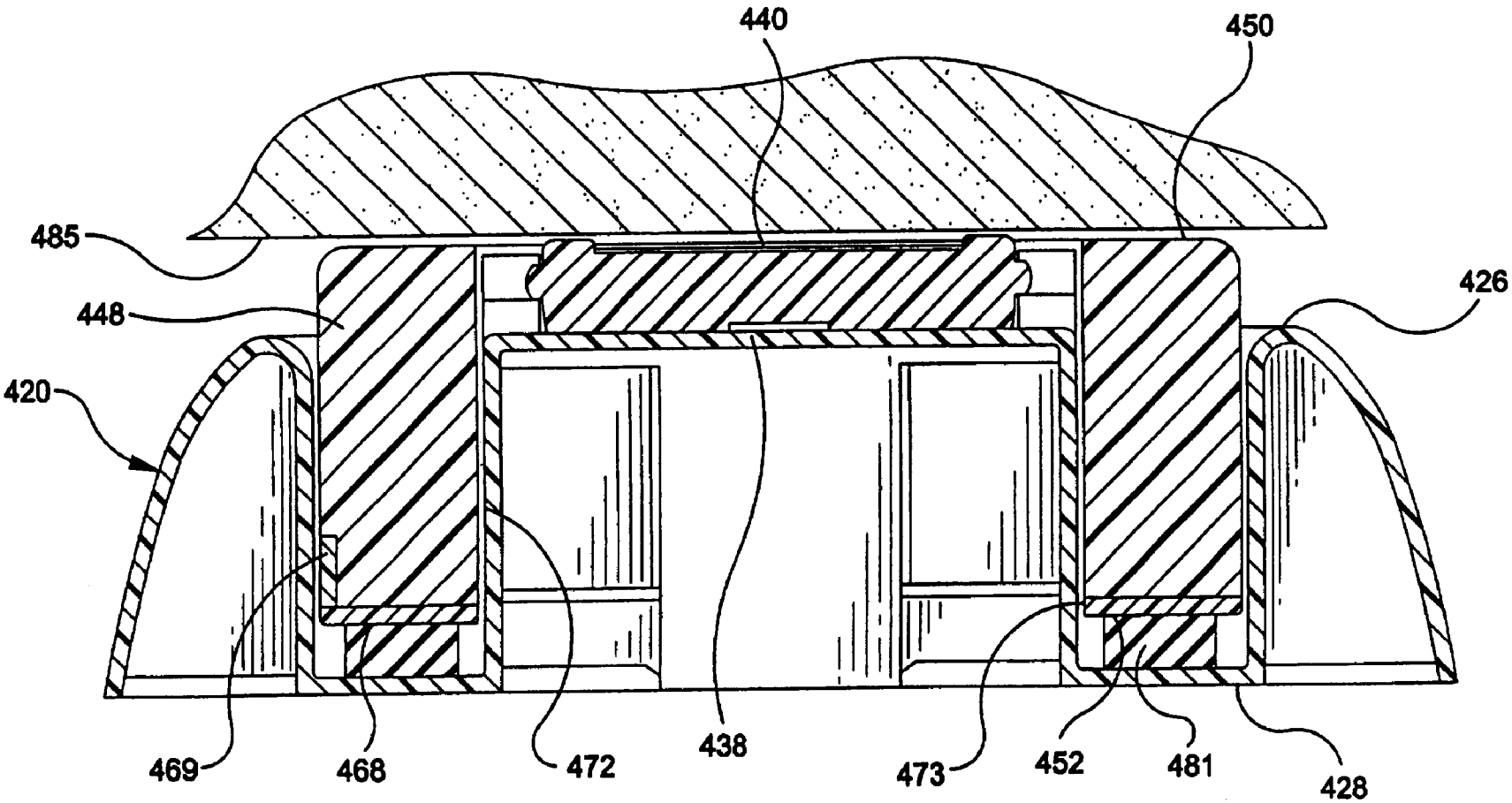
FIG. 10C shows the shaving assembly of FIGS. 10A and 10B during a shaving operation.

FIGS. 10A and 10C show a shaving assembly in accordance with other preferred embodiment of the present invention wherein the resilient element 491 is a compressible foam. In this embodiment, the shaving assembly 420 includes base 422 having an upper end 426 and a lower end 428. A cartridge receiver 438 for a razor blade cartridge 440 is secured to the base 422. The cartridge receiver 438 and the razor blade cartridge 440 are stationary and do not move relative to the base 422. The shaving assembly includes a cake of shaving preparation 448 having a top surface 450 and a bottom surface 452. The cake 448 is provided atop a top surface 472 of a supporting element 468. Compressible foam 481 is disposed between the base 422 and the lower surface 483 of the support element 468.

Referring to FIG. 10B, during a shaving operation, the shaving assembly 420 is juxtaposed with a shaving surface 485. Initially, the top surface 450 of the shaving preparation 448 lies above the cutting blades of razor blade cartridge 440. Referring to FIG. 10C, upon engaging the shaving surface 485, the shaving preparation 448 is forced to move toward the lower end 428 of the base 422 thereby compressing compressible foam 481. The shaving preparation continues to move toward the lower end of base 422 until the top surface 450 lies in the same plane as the razor blade cartridge 440. During use, because shaving preparation 448 sits atop resilient element 481, the shaving preparation 448 is able to undulate in an effort to conform better to the shaving surface.

Figure 11:
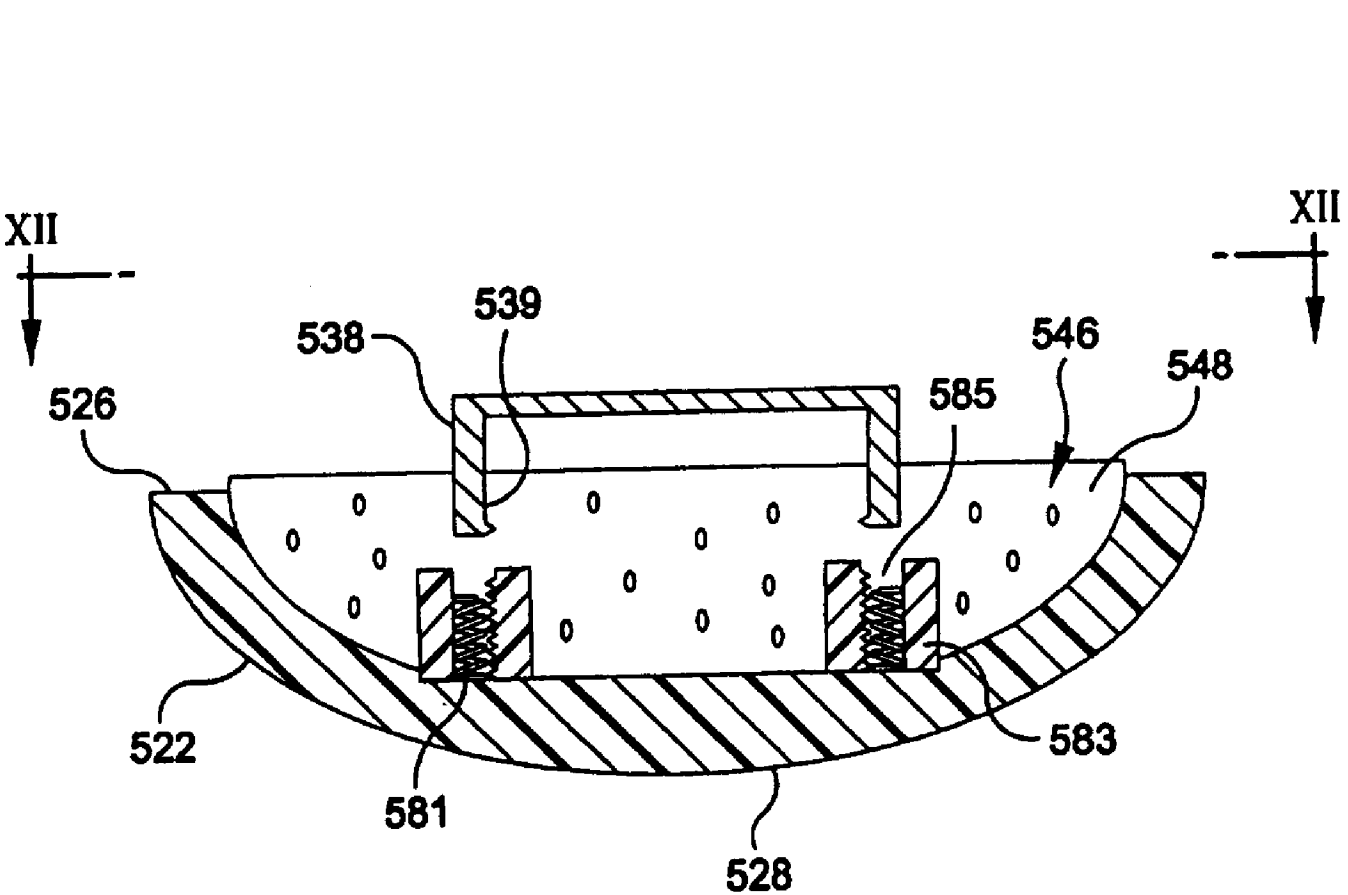
FIG. 11 shows an exploded fragmentary side view of a shaving assembly, in accordance with other preferred embodiments of the present invention.

FIG. 11 shows a shaving assembly 520 in accordance with further preferred embodiments of the present invention wherein the cartridge receiver 538 is resiliently mounted to the base 522 of the shaving assembly. The shaving assembly includes base 522 having an upper end 526, a lower end 528 and a hollow space 546 therebetween that defines an opening at the upper end 526 of the base. The cartridge receiver 538 is connected to base 522 via resilient element 581 so that the cartridge receiver 538 is movable relative to base 522. In the particular embodiment shown in FIG. 11, the base includes resilient element supports 583 having a central opening 585 containing springs 581. The cartridge receiver 538 includes legs 539 secured in the central openings 585 and in contact with the springs 581 for biasing the cartridge receiver 538 toward the lower end 528 of base 522 and the springs 581 are resilient for continuously urging the cartridge. receiver 538 toward the upper end 526 of base 522.

Figure 12:
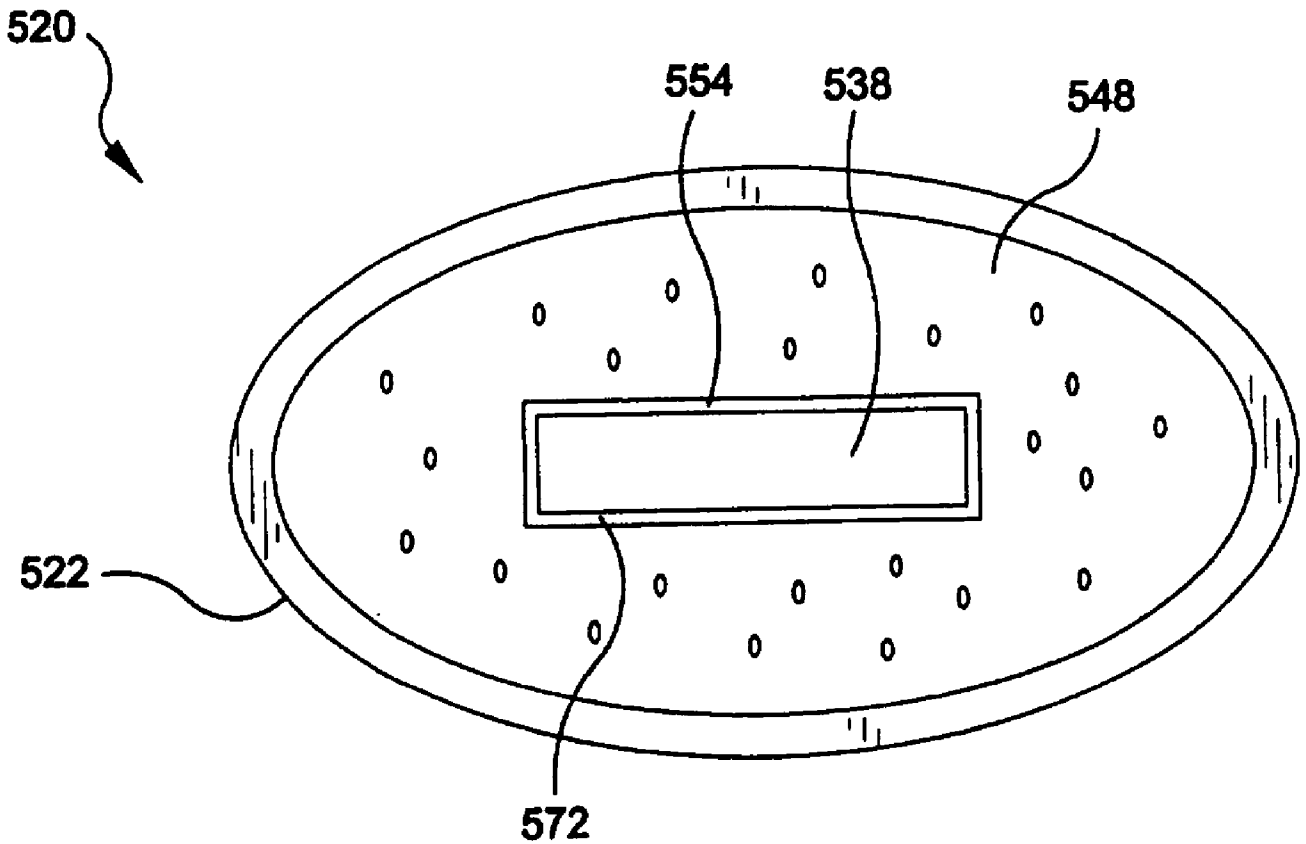
FIG. 12 shows a top view of the assembly of FIG. 111 taken along lines XII—XII of FIG. 11.

FIG. 12 shows a top view of the shaving assembly shown in FIG. 11. In this embodiment, the base has a substantially oval-shaped outer perimeter and the shaving preparation 548 is directly molded or press-fitted into the hollow space of the base. The shaving preparation 548 has an axial bore 554 extending therethrough. The perimeter of the bore is greater than the outer perimeter 572 of the cartridge receiver 538 so that the resiliently mounted receiver may pass through the axial bore 554 of the shaving preparation 548 during a shaving operation.

Figure 13A:
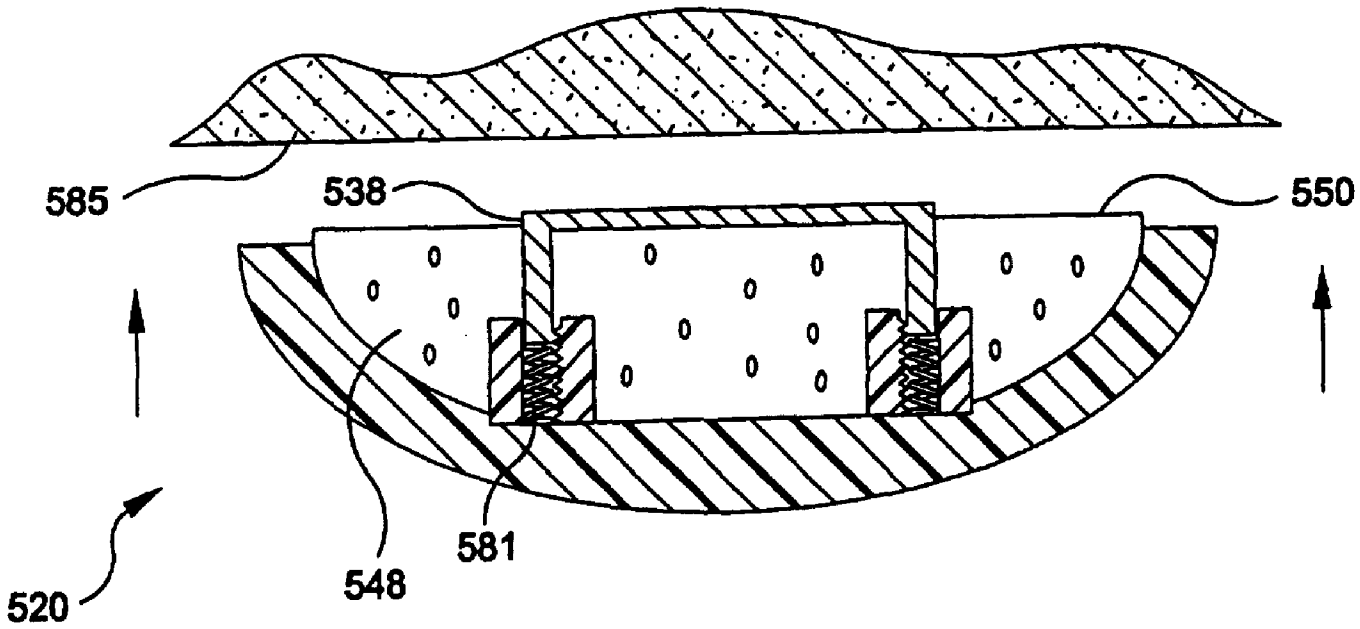
FIG. 13A shows a cross-sectional view of the shaving assembly of FIG. 11 before commencement of a shaving operation.
Figure 13B:
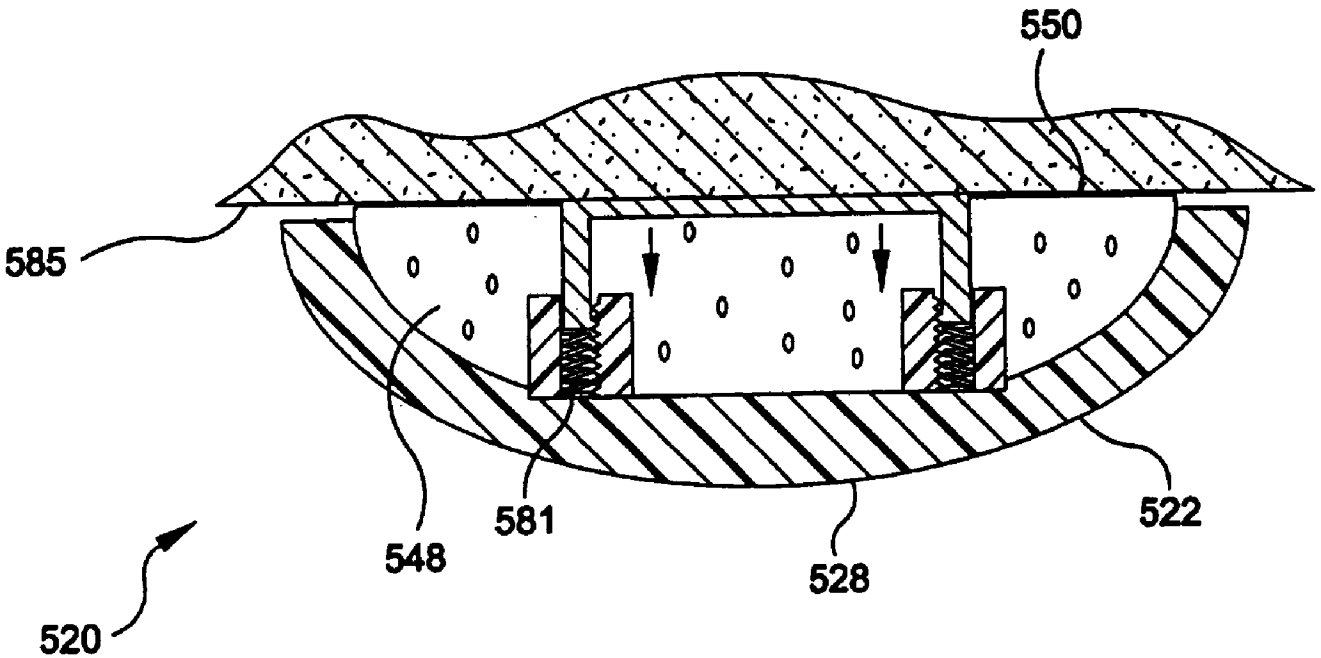
FIG. 13B shows the shaving assembly of FIG. 13A during a shaving operation.

FIGS. 13A and 13B show the shaving assembly 520 of FIGS. 11 and 12 during a shaving operation. The shaving assembly 520 is juxtaposed with a shaving surface 585 so that the top surface 550 of the shaving preparation 548 faces the shaving surface 585. The resilient element 581 urges the cartridge receiver 538 and the razor blade cartridge (not shown) to a position above the top surface 550 of shaving preparation 548. When the top surface 550 of shaving preparation 548 contacts the shaving surface 585, the latter exerts a force upon the top surface 550 of shaving preparation 548 for compressing springs 581. The force exerted by the shaving surface 585 continues to force the cartridge receiver 538 toward the lower end 528 of base 522 until the cutting blades of the razor blade cartridge lie in a common plane with the top surface 550 of the shaving preparation 548.

Figure 14:
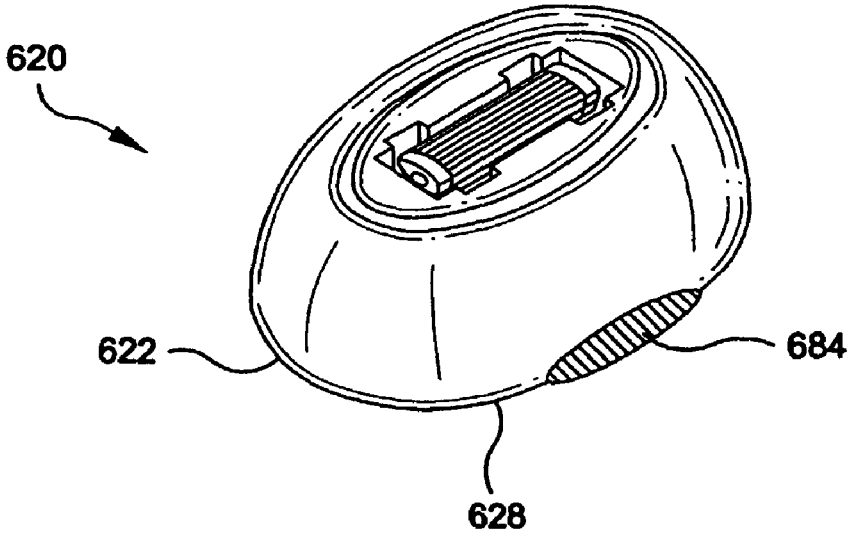
FIG. 14 shows a perspective view of a shaving assembly, in accordance with further preferred embodiments of the present invention.

FIG. 14 shows a shaving assembly 620 in accordance with further preferred embodiments of the present invention. The shaving assembly 620 is substantially similar to that shown in FIG. 8, however, the lower end 628 of base 622 includes a rotatable knob 684 which is part of an adjusting assembly similar to that shown in FIG. 1.

Figure 15:
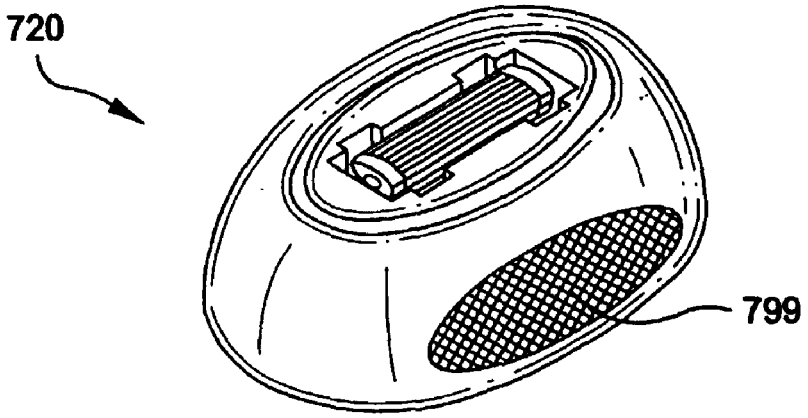
FIG. 15 shows a perspective view of a shaving assembly, in accordance with still further preferred embodiments of the present invention.

FIG. 15 shows a shaving assembly 720 in accordance with other preferred embodiments of the present invention. The shaving assembly 720 is similar to that shown in FIG. 8, however, the adjusting mechanism includes the ratcheting arrangement with a depressible button 799 similar to that shown in FIG. 7.

Figure 16:
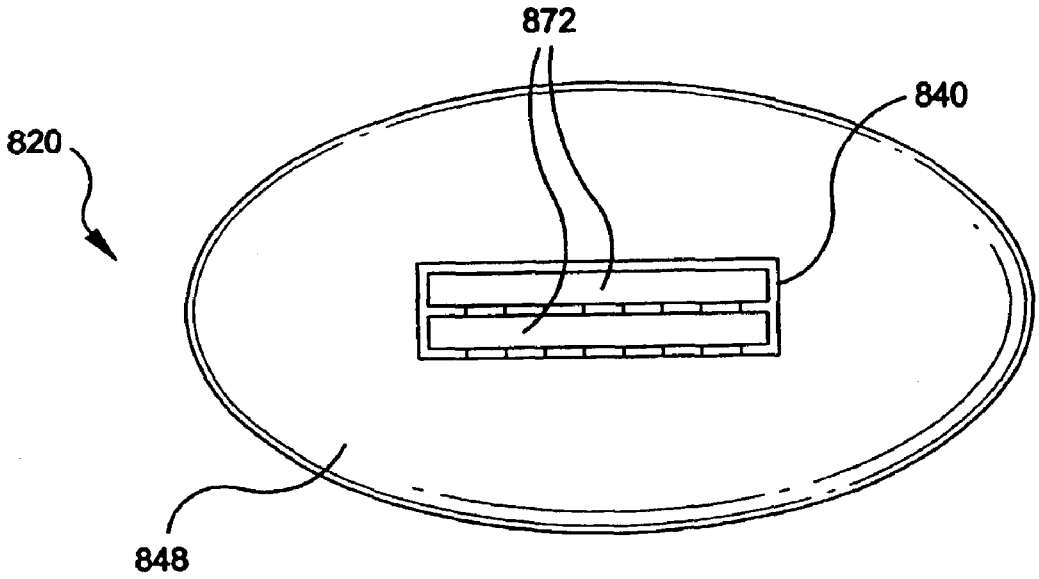
FIG. 16 shows a top view of a shaving assembly, in accordance with other preferred embodiments of the present invention.
Figure 17:
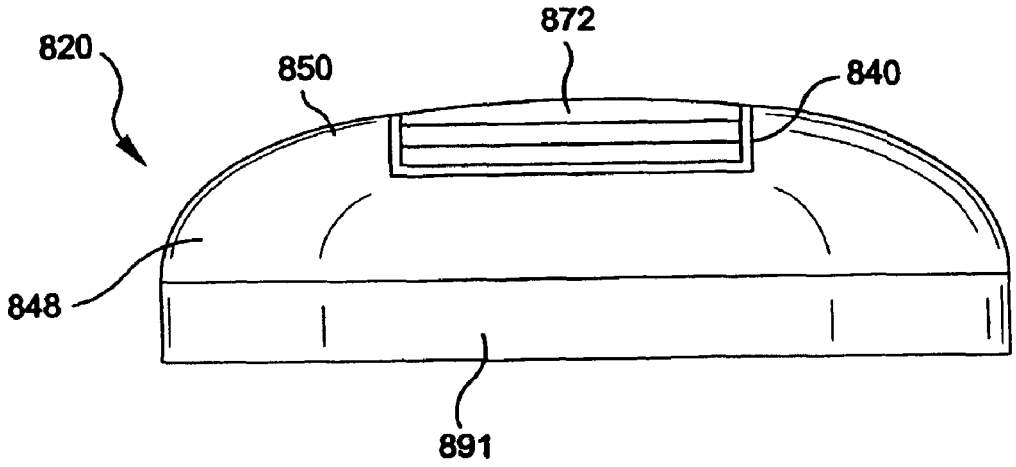
FIG. 17 shows a front view of the shaving assembly shown in FIG. 16.
Figure 18:
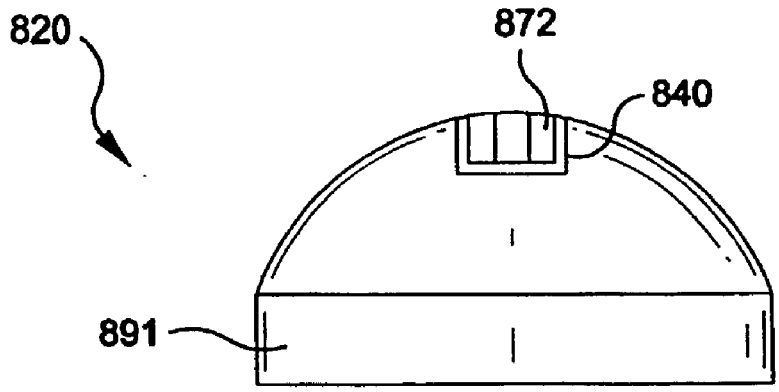
FIG. 18 shows an end view of the shaving assembly shown in FIGS. 16 and 17.

FIGS. 16–18 show a shaving assembly 820 in accordance with further preferred embodiments of the present invention. Referring to FIGS. 16 and 17, the shaving assembly 820 includes a razor blade cartridge 840 embedded in the shaving preparation 848 so that the cutting blades 872 of the razor blade cartridge 840 lie in the same plane as the top surface of the shaving preparation 848. The shaving assembly also includes a gripper element 891 secured to the shaving preparation 848, preferably covering an area of the shaving preparation remote from the razor blade cartridge 840. The gripper element 891 provides a surface for holding the shaving assembly 820 and particularly for holding the shaving preparation portion of the assembly. The gripper element 891 may comprise a rubber or a foam material having a textured or non-textured surface. The gripper element may also be deposited over one or more surface areas of the shaving preparation 848, such as by painting the gripper element onto the shaving preparation.

FIG. 18 shows an end view of the shaving assembly shown in FIG. 17. As shown in FIGS. 17 and 18, the blades 872 of the razor blade cartridge 840 preferably have a longitudinal axis that is substantially parallel to the length of the shaving preparation.

Figure 19:
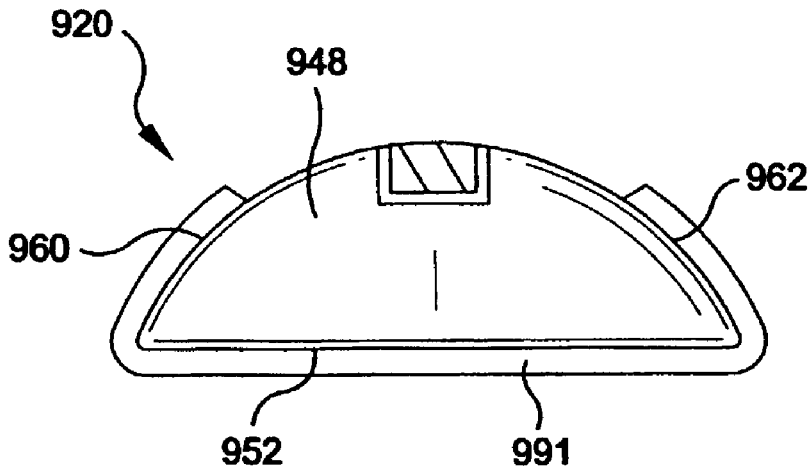
FIG. 19 shows an end view of the shaving assembly, in accordance with the preferred embodiments of the present invention.

FIG. 19 shows a shaving assembly 920 in accordance with further preferred embodiments of the present invention. The shaving assembly 920 is substantially similar to that shown in FIGS. 16–18, however, the gripper element 991 is disposed over the bottom surface 952 and the side surfaces 960 and 962 of the shaving preparation 948 so as to provide a larger gripping area.

Figure 20:
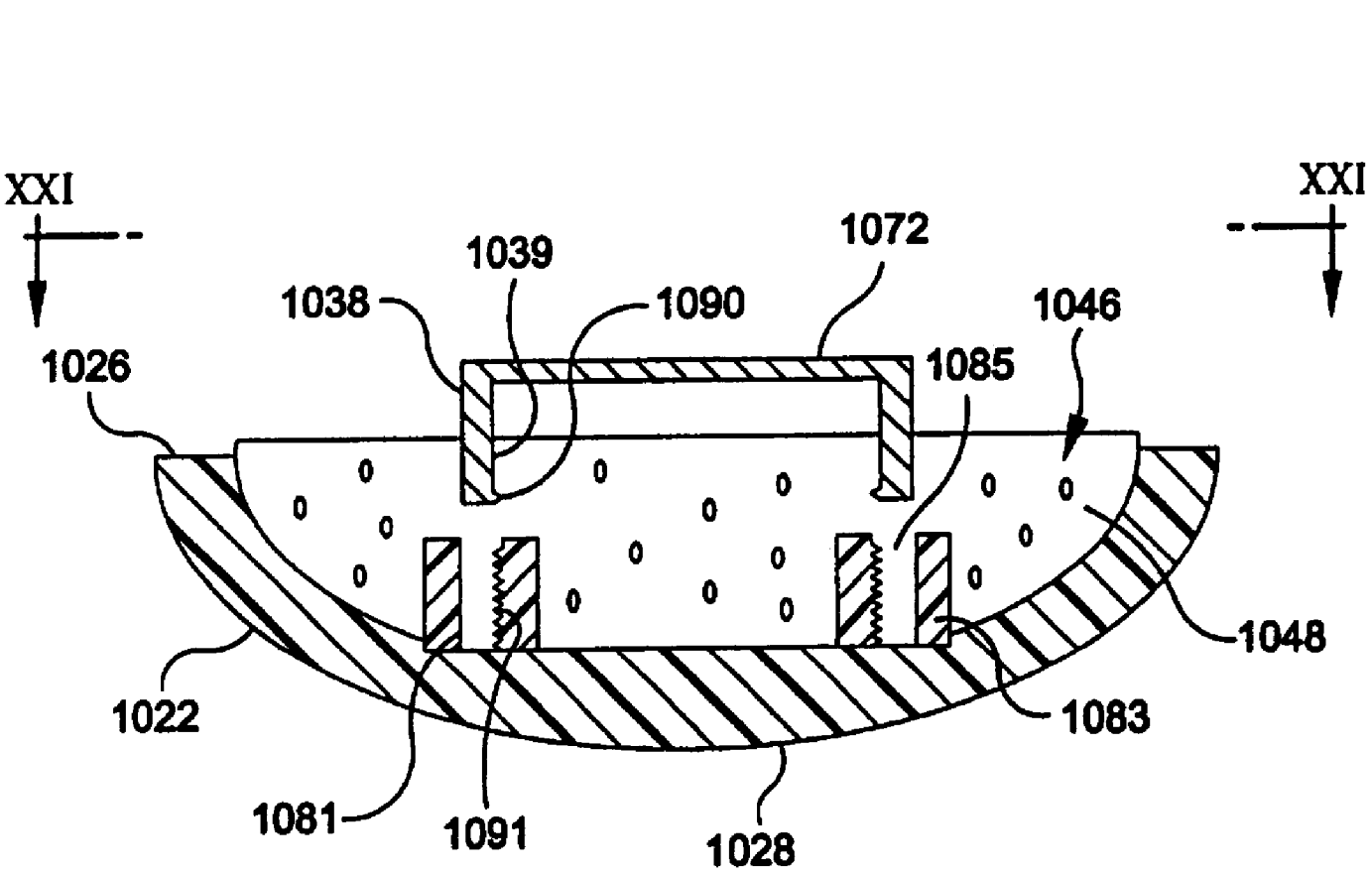
FIG. 20 shows an exploded fragmentary side view of a shaving assembly, in accordance with other preferred embodiments of the present invention.

FIG. 20 shows a shaving assembly 1020 in accordance with further preferred embodiments of the present invention wherein the cartridge receiver 1038 is ratchet mounted to the base 1022 of the shaving assembly. The shaving assembly includes base 1022 having an upper end 1026, a lower end 1028 and a hollow space 1046 therebetween that defines an opening at the upper end 1026 of the base. The cartridge receiver 1038 is connected to base 1022 via a protruding element 1090 so that the cartridge receiver 1038 is movable relative to base 1022. In the particular embodiment shown in FIG. 20, the base includes cartridge receiver leg supports 1083 having a central opening 1085 containing teeth 1091 on the inside of one support. The cartridge receiver 1038 includes legs 1039 secured in the central openings 1085 and engaged with the teeth 1091 for ratcheting the cartridge receiver 1038 toward the lower end 1028 of base 1022.

Figure 21:
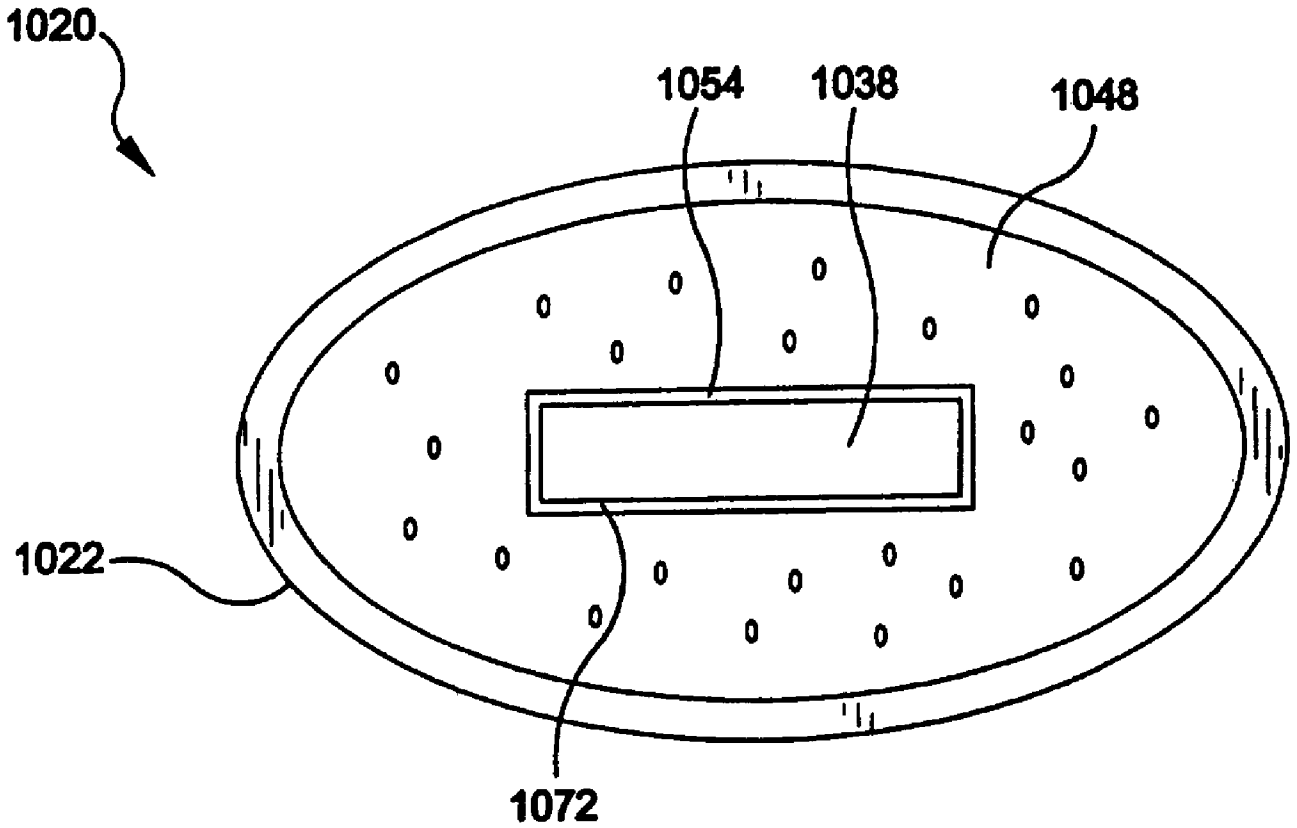
FIG. 21 shows a top view of the assembly of FIG. 20 taken along lines XXI—XXI of FIG. 20.

FIG. 21 shows a top view of the shaving assembly shown in FIG. 20. In this embodiment, the base has a substantially oval-shaped outer perimeter and the shaving preparation 1048 is directly molded or press-fitted into the hollow space of the base. The shaving preparation 1048 has an axial bore 1054 extending therethrough. The perimeter of the bore is greater than the outer perimeter 1072 of the cartridge receiver 1038 so that the ratchet mounted receiver may pass through the axial bore 1054 of the shaving preparation 1048 during a shaving operation.

Figure 22A:
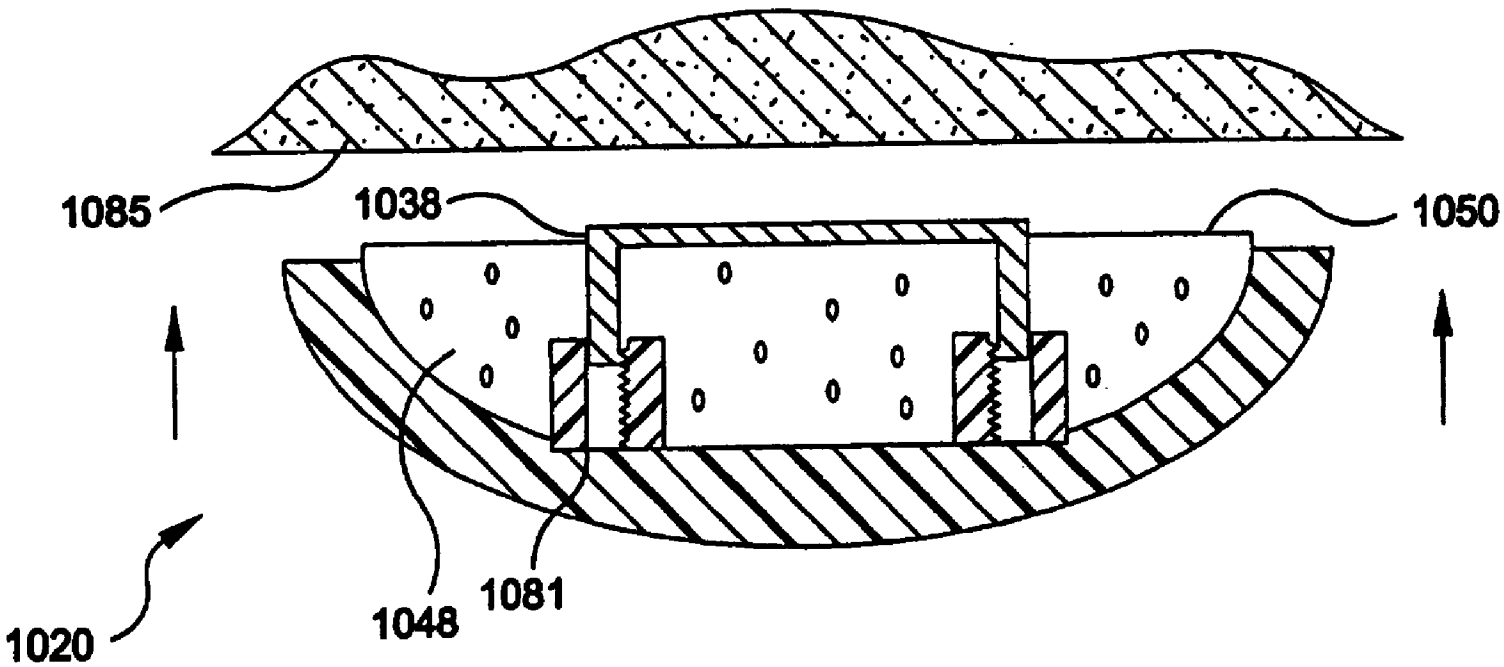
FIG. 22A shows a cross-sectional view of the shaving assembly of FIG. before commencement of a shaving operation.
Figure 22B:
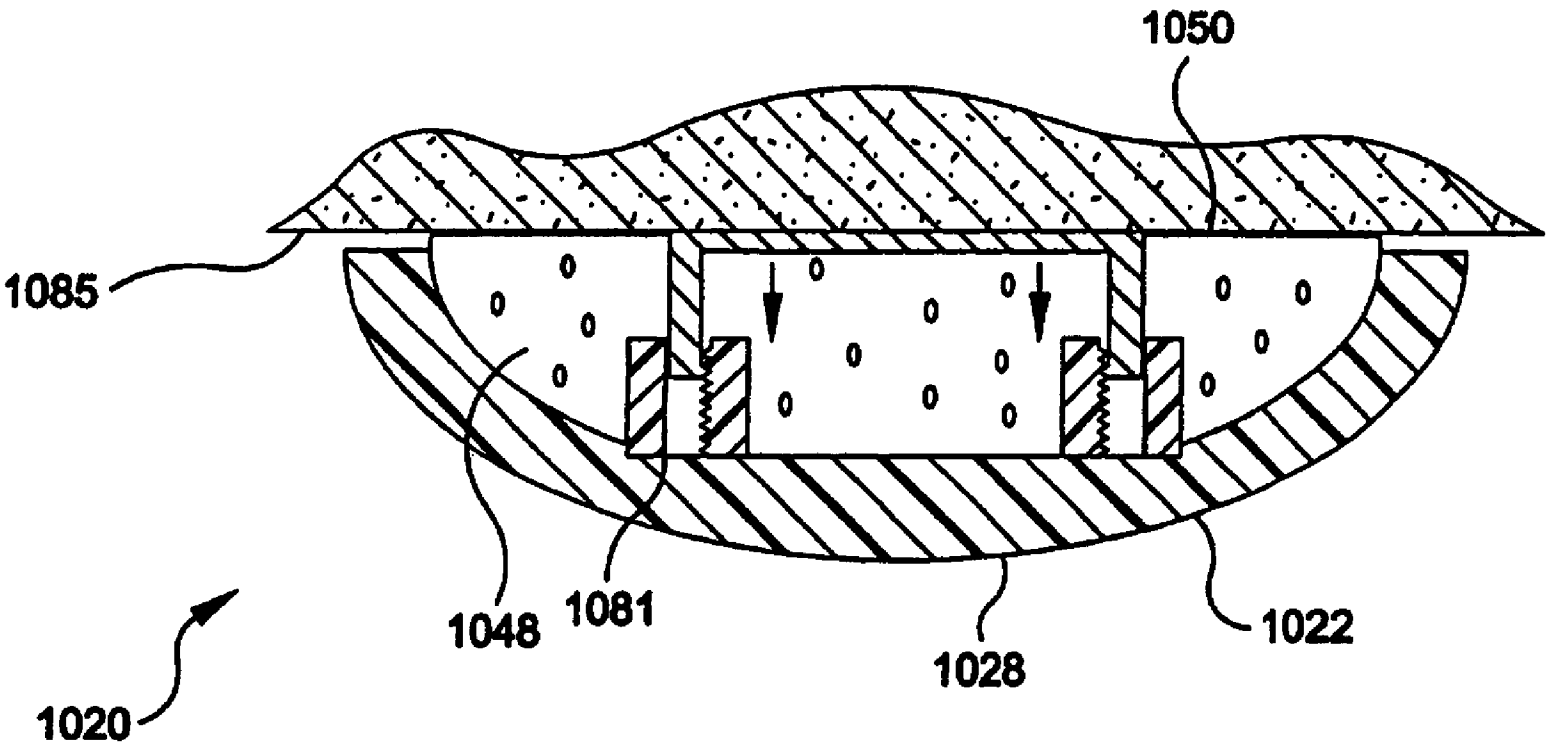
FIG. 22B shows the shaving assembly of FIG. 20 during a shaving operation.

FIGS. 22A and 22B show the shaving assembly 1020 of FIGS. 20 and 21 during a shaving operation. The shaving assembly 1020 is juxtaposed with a shaving surface 1085 so that the top surface 1050 of the shaving preparation 1048 faces the shaving surface 1085. The cutting blades of the razor blade cartridge (not shown) are in the same plane as the top surface 1050 of shaving preparation 1048. When the top surface 1050 of shaving preparation 1048 contacts the shaving surface 1085, the latter exerts a force upon the top surface 1050 of shaving preparation 1048 and the cartridge receiver 1038. The force exerted by the shaving surface 1085 continues to force the cartridge receiver 1038 toward the lower end 1028 of base 1022. As the shaving preparation 1048 wears, the force exerted causes the cartridge receiver 1038 to incrementally ratchet toward the lower end 1028 of base 1022. Thus, maintaining the cutting blades of the razor blade cartridge (not shown) are in the same plane as the top surface 1050 of the shaving preparation 1048.

Although the invention herein has been described with reference to particular embodiments, it is to be understood that these embodiments are merely illustrative of the principles and applications of the present invention. It is contemplated that razors having various types of cutting edges may be used. For example, the present invention may be used with razors that do not have elongated blades with cutting edges, such as razors having cutting blades of various shapes. It is therefore to be understood that numerous modifications may be made to the illustrative embodiments and that other arrangements may be devised without departing from the spirit and scope of the present invention as defined by the appended claims.

What is claimed is:

1. A shaving preparation cartridge, comprising:

a shaving preparation cake having a top surface, a bottom surface, one or more side walls extending between the top surface and the bottom surface, and a bore disposed in the top surface, wherein the bore is defined by an edge extending around substantially the entire periphery of the bore, and the bore extends from the edge inwardly away from the top surface in a direction substantially perpendicular to the portion of the top surface in which the edge is disposed, and the bore has a width and a length both extending within the plane of the top surface, and the length is greater than the width; and a support element attached to the cake, the support element including a central opening.

2. The shaving preparation cartridge of claim 1, wherein the central opening is sized to receive a cartridge receiver.

3. The shaving preparation cartridge of claim 2, wherein the support element includes one or more tabs for securing the shaving preparation cake to the support element.

4. The shaving preparation cartridge of claim 2, wherein the bore extends from the top surface toward the bottom surface of the shaving preparation cake.

5. The shaving preparation cartridge of claim 4, wherein the bore is sized to receive a cartridge receiver that selectively secures a razor blade cartridge.

6. The shaving preparation cartridge of claim 5, wherein the shaving preparation cake is substantially oval shaped.

7. The shaving preparation cartridge of claim 6, wherein the shaving preparation cake comprises one or more of a lubricant, a skin beneficial ingredient, and a scent.

8. The shaving preparation cartridge of claim 1, wherein the support element includes means for attaching to a mechanism for adjusting the position of the shaving preparation cartridge relative to a shaving assembly.

9. The shaving preparation cartridge of claim 8, wherein the means for attaching includes a threaded bore.

10. The shaving preparation cartridge of claim 9, wherein the shaving preparation cake includes slits formed in the one or more side walls, extending from the top surface toward the bottom surface of the cake.

11. The shaving preparation cartridge of claim 8, wherein the bore extends from the top surface toward the bottom surface of the shaving preparation cake.

12. The shaving preparation cake of claim 11, wherein the bore is sized to receive a cartridge receiver that selectively secures a razor blade cartridge.

13. The shaving preparation cake of claim 12, wherein the shaving preparation cake is substantially oval shaped.

14. The shaving preparation cake of claim 9, wherein the shaving preparation cake comprises one or more of a lubricant, a skin beneficial ingredient, and a scent.

* * * * *